US012808568B2

(12) United States Patent
Kim et al.

(10) Patent No.: US 12,808,568 B2
(45) Date of Patent: Nov. 24, 2026

(54) AIR CONDITIONER AND CONTROLLING METHOD THEREOF

(71) Applicant: Samsung Electronics Co., Ltd., Suwon-si (KR)

(72) Inventors: Taewoo Kim, Suwon-si (KR); Seungwon Oh, Suwon-si (KR); Daehui Kim, Suwon-si (KR); Minseok Kim, Suwon-si (KR); Younghoon Kim, Suwon-si (KR); Seungjun Park, Suwon-si (KR); Junkyu Seong, Suwon-si (KR); Sunhee Son, Suwon-si (KR); Younguk Yun, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 133 days.

(21) Appl. No.: 18/824,312

(22) Filed: Sep. 4, 2024

(65) Prior Publication Data

US 2024/0426509 A1 Dec. 26, 2024

Related U.S. Application Data

(63) Continuation of application No. PCT/KR2023/003418, filed on Mar. 14, 2023.

(30) Foreign Application Priority Data

Apr. 28, 2022 (KR) ..... 10-2022-0053109

(51) Int. Cl.

| | |
|---|---|
| ***F24F 11/86*** | (2018.01) |
| ***F25B 49/02*** | (2006.01) |
| *F24F 110/10* | (2018.01) |
| *F24F 120/20* | (2018.01) |

(52) U.S. Cl.

CPC ..... *F24F 11/86* (2018.01); *F25B 49/022* (2013.01); *F24F 2110/10* (2018.01);

(Continued)

(58) Field of Classification Search

CPC .... F24F 11/85; F24F 2120/20; F24F 2110/10; F25B 49/022; F25B 2600/0251;

(Continued)

(56) References Cited

U.S. PATENT DOCUMENTS

| | | | | |
|---|---|---|---|---|
| 6,701,732 | B2 | 3/2004 | Shimoda | |
| 2019/0120513 | A1 * | 4/2019 | Tamaki | F25B 13/00 |

(Continued)

FOREIGN PATENT DOCUMENTS

| | | | |
|---|---|---|---|
| CN | 1755257 | A | 4/2006 |
| JP | 1993-093540 | A | 4/1993 |

(Continued)

OTHER PUBLICATIONS

International Search Report dated Jul. 6, 2023, issued in International Patent Application No. PCT/KR2023/003418.

*Primary Examiner* — Marc E Norman
(74) *Attorney, Agent, or Firm* — Jefferson IP Law, LLP

(57) ABSTRACT

An air conditioner is provided. The air conditioner includes a compressor configured to compress a refrigerant, an indoor heat exchanger in which heat exchange between indoor air and the refrigerant is performed, a discharge temperature sensor configured to measure a discharge temperature of air at which the heat exchange has been completed, an intake temperature sensor configured to measure an intake temperature of the indoor air drawn into the indoor heat exchanger, an inputter configured to receive a target temperature from a user, memory storing one or more computer programs, and one or more processors communicatively coupled the compressor, the indoor heat exchanger, the discharge temperature sensor, the intake temperature sensor, the inputter, and the memory, wherein the one or more computer programs include computer-executable instructions that, when executed by the one or more processors individually or collectively, cause the air conditioner to (Continued)

adjust an operating frequency of the compressor by comparing the intake temperature and the target temperature, and control the compressor to reduce the operating frequency in response to the discharge temperature reaching a reference temperature.

20 Claims, 15 Drawing Sheets

(52) U.S. Cl.
CPC . *F24F 2120/20* (2018.01); *F25B 2700/21172* (2013.01); *F25B 2700/21173* (2013.01)

(58) Field of Classification Search
CPC .... F25B 2600/0253; F25B 2700/21172; F25B 2700/21173
See application file for complete search history.

(56) References Cited

U.S. PATENT DOCUMENTS

2019/0241044 A1* 8/2019 Ito ..... B60H 1/22
2020/0072550 A1* 3/2020 Wang ..... F25B 6/02
2020/0086713 A1* 3/2020 Yamaguchi ..... B60H 1/00

FOREIGN PATENT DOCUMENTS

| | | | |
|---|---|---|---|
| JP | 4032634 | B2 | 1/2008 |
| JP | 2010-261609 | A | 11/2010 |
| JP | 6642379 | B2 | 2/2020 |
| KR | 10-0159606 | B1 | 1/1999 |
| KR | 10-0168186 | B1 | 1/1999 |
| KR | 10-0307226 | B1 | 11/2001 |
| KR | 10-2002-0017086 | A | 3/2002 |
| KR | 10-2002-0025648 | A | 4/2002 |
| KR | 10-0321241 | B1 | 7/2002 |
| KR | 10-0505237 | B1 | 8/2005 |
| KR | 10-0737314 | B1 | 7/2007 |
| KR | 10-2008-0069824 | A | 7/2008 |
| KR | 10-2009-0114832 | A | 11/2009 |
| KR | 10-2010-0048194 | A | 5/2010 |
| KR | 10-2011-0001667 | A | 1/2011 |
| KR | 10-1166380 | B1 | 7/2012 |
| KR | 10-2060714 | B1 | 12/2019 |
| KR | 10-2020-0089046 | A | 7/2020 |

* cited by examiner

FIG. 10

T: REFERENCE TEMPERATURE

| TEMPERATURE DROP | | TEMPERATURE RISE | |
|---|---|---|---|
| SECTION | FREQUENCY OPERATION | SECTION | FREQUENCY OPERATION |
| DISCHARGE TEMPERATURE ≥ T+1° C | ROOM TEMPERATURE CONTROL | DISCHARGE TEMPERATURE ≥ T+1.1° C | ROOM TEMPERATURE CONTROL |
| T+1° C > DISCHARGE TEMPERATURE ≥ T | FREQUENCY MAINTENANCE | T+1.1° C > DISCHARGE TEMPERATURE ≥ T+0.1° C | FREQUENCY MAINTENANCE |
| T > DISCHARGE TEMPERATURE ≥ T-1° C | FREQUENCY REDUCTION [-3HZ] | T+0.1° C > DISCHARGE TEMPERATURE ≥ T-0.9° C | FREQUENCY REDUCTION [-3HZ] |
| T-1° C > DISCHARGE TEMPERATURE | FREQUENCY REDUCTION [-3HZ] | T-0.9° C > DISCHARGE TEMPERATURE | FREQUENCY REDUCTION [-3HZ] |

FIG. 14

T: REFERENCE TEMPERATURE

| TEMPERATURE RISE | | TEMPERATURE DROP | |
|---|---|---|---|
| SECTION | FREQUENCY OPERATION | SECTION | FREQUENCY OPERATION |
| DISCHARGE TEMPERATURE ≥ T+1° C | FREQUENCY REDUCTION [-6Hz] | DISCHARGE TEMPERATURE ≥ T+0.7° C | FREQUENCY REDUCTION [-6Hz] |
| T+1° C > DISCHARGE TEMPERATURE ≥ T | FREQUENCY REDUCTION [-3HZ] | T+0.7° C > DISCHARGE TEMPERATURE ≥ T-0.3° C | FREQUENCY REDUCTION[-3HZ] |
| T > DISCHARGE TEMPERATURE ≥ T-1° C | FREQUENCY MAINTENANCE | T-0.3° C > DISCHARGE TEMPERATURE ≥ T-1.3° C | FREQUENCY MAINTENANCE |
| T-1° C > DISCHARGE TEMPERATURE | CONDENSATION TEMPERATURE CONTROL | T-1.3° C > DISCHARGE TEMPERATURE | CONDENSATION TEMPERATURE CONTROL |

AIR CONDITIONER AND CONTROLLING METHOD THEREOF

CROSS-REFERENCE TO RELATED APPLICATION(S)

This application is a continuation application, claiming priority under § 365 (c), of an International application No. PCT/KR2023/003418, filed on Mar. 14, 2023, which is based on and claims the benefit of a Korean patent application number 10-2022-0053109, filed on Apr. 28, 2022, in the Korean Intellectual Property Office, the disclosure of which is incorporated by reference herein in its entirety.

BACKGROUND

1. Field

The disclosure relates to an air conditioner configured to consider a user perceived temperature and a control method thereof.

2. Description of Related Art

An air conditioner is a device that cools or heats air using movement of heat generated from evaporation and condensation of a refrigerant, and discharges the cooled or heated air to condition air in an indoor space. The air conditioner may cool or heat air by circulating a refrigerant through a compressor, an indoor heat exchanger, and an outdoor heat exchanger during a cooling or heating operation.

An indoor unit of the air conditioner includes an intake portion provided to draw in indoor air, a heat exchanger configured to exchange heat with the drawn air, and a discharge portion provided to discharge the heat-exchanged air. The air conditioner controls the compressor by targeting a target temperature that is set by a user. More particularly, the air conditioner controls a frequency of the compressor based on difference between an intake temperature measured at the intake portion and the target temperature set by the user.

The user can feel a temperature of the air discharged from the discharge portion, but when the compressor is started or stopped according to the difference between the above-mentioned intake temperature and the target temperature, the difference between the target temperature set by the user and the expected perceived temperature may occur.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide an air conditioner configured to reflect a discharge temperature in addition to an intake temperature, to compressor control, and a controlling method thereof.

Additional aspects will be set forth in part in the description which follows and, in part, will be apparent from the description, or may be learned by practice of the presented embodiments.

In accordance with an aspect of the disclosure, an air conditioner is provided. The air conditioner includes a compressor configured to compress a refrigerant, an indoor heat exchanger in which heat exchange between indoor air and the refrigerant is performed, a discharge temperature sensor configured to measure a discharge temperature of air at which the heat exchange is completed, an intake temperature sensor configured to measure an intake temperature of the indoor air drawn into the indoor heat exchanger, an inputter configured to receive a target temperature from a user, memory storing one or more computer programs, and one or more processors communicatively coupled the compressor, the indoor heat exchanger, the discharge temperature sensor, the intake temperature sensor, the inputter, and the memory, wherein the one or more computer programs include computer-executable instructions that, when executed by the one or more processors individually or collectively, cause the air conditioner to adjust an operating frequency of the compressor by comparing the intake temperature and the target temperature, and control the compressor to reduce the operating frequency in response to the discharge temperature reaching a reference temperature.

The one or more computer programs further include computer-executable instructions that, when executed by the one or more processors individually or collectively, cause the air conditioner to adjust the operating frequency of the compressor or stop the compressor based on the intake temperature, and, in response to the discharge temperature reaching the reference temperature after the intake temperature reaches the target temperature, the one or more computer programs further include computer-executable instructions that, when executed by the one or more processors individually or collectively, cause the air conditioner to control the compressor to reduce the operating frequency instead of stopping the compressor.

The one or more computer programs further include computer-executable instructions that, when executed by the one or more processors individually or collectively, cause the air conditioner to maintain the operating frequency at a second operating frequency reduced from the first operating frequency in response to the discharge temperature reaching the reference temperature.

In response to the discharge temperature increasing in a section, in which the compressor is operated at the second operating frequency, and reaching a predetermined first temperature, the controller may be configured to maintain a third operating frequency increased from the second operating frequency.

In response to the discharge temperature decreasing in a section, in which the compressor is operated at the third operating frequency, and reaching the reference temperature, the one or more computer programs further include computer-executable instructions that, when executed by the one or more processors individually or collectively, cause the air conditioner to maintain the second operating frequency reduced from the third operating frequency.

The reference temperature is a predetermined cooling reference temperature.

In response to the discharge temperature decreasing in a section, in which the compressor is operated at the second operating frequency, and reaching a predetermined second temperature, the one or more computer programs further include computer-executable instructions that, when executed by the one or more processors individually or collectively, cause the air conditioner to maintain a fourth operating frequency increased from the second operating frequency.

In response to the discharge temperature increasing in a section, in which the compressor is operated at the fourth operating frequency, and reaching the reference temperature, the controller is configured to maintain the second operating frequency reduced from the fourth operating frequency.

The reference temperature is a predetermined heating reference temperature.

The one or more computer programs further include computer-executable instructions that, when executed by the one or more processors individually or collectively, cause the air conditioner to control the compressor to increase the operating frequency to the first operating frequency in response to start of a cooling operation or heating operation, and configured to maintain the first operating frequency in response to the intake temperature reaching the target temperature.

The one or more computer programs further include computer-executable instructions that, when executed by the one or more processors individually or collectively, cause the air conditioner to control the operating frequency based on a predetermined fuzzy table, in a section in which the operating frequency is increased to the first operating frequency.

In accordance with another aspect of the disclosure, a method of controlling an air conditioner is provided. The air conditioner includes a compressor configured to compress a refrigerant, an indoor heat exchanger in which heat exchange between indoor air and the refrigerant is performed, a discharge temperature sensor configured to measure a discharge temperature, an intake temperature sensor configured to measure an intake temperature, and an inputter configured to receive a target temperature from a user, the method including receiving the target temperature from the user, obtaining the intake temperature and the discharge temperature, adjusting an operating frequency of the compressor by comparing the intake temperature and the target temperature, and controlling the compressor to reduce the operating frequency of the compressor in response to the discharge temperature reaching a reference temperature.

The controlling of the compressor includes adjusting the operating frequency of the compressor or stopping the compressor based on the intake temperature, and controlling the compressor to reduce the operating frequency instead of stopping the compressor, in response to the discharge temperature reaching the reference temperature after the intake temperature reaches the target temperature.

The controlling of the compressor includes maintaining the operating frequency at a second operating frequency reduced from the first operating frequency in response to the discharge temperature reaching the reference temperature.

The reference temperature is determined based on at least one of a size of the indoor heat exchanger and a blowing capacity of the air conditioner.

It is possible to minimize a difference between a target temperature set by a user and a user perceived temperature by reflecting a temperature of air discharged from an air conditioner to compressor control in addition to an intake temperature corresponding to a room temperature.

Further, it is possible to provide a consistent perceived temperature to a user until cooling and heating operations of an air conditioner are terminated.

In accordance with another aspect of the disclosure, one or more non-transitory computer-readable storage media storing computer-executable instructions that, when executed by one or more processors individually or collectively, cause an air conditioner to perform operations of controlling the air conditioner are provided. The air conditioner includes a compressor configured to compress a refrigerant, an indoor heat exchanger in which heat exchange between indoor air and the refrigerant is performed, a discharge temperature sensor configured to measure a discharge temperature, an intake temperature sensor configured to measure an intake temperature, and an inputter configured to receive a target temperature from a user. The operations include receiving the target temperature from the user, obtaining the intake temperature and the discharge temperature, adjusting an operating frequency of the compressor by comparing the intake temperature and the target temperature, and controlling the compressor to reduce the operating frequency of the compressor in response to the discharge temperature reaching a reference temperature.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which:

FIGS. 8, 9, and 10 illustrate a relationship between an operating frequency of a compressor and a discharge temperature during a cooling operation of the air conditioner according to various embodiments of the disclosure;

FIGS. 12, 13, and 14 illustrate a relationship between an operating frequency of a compressor and a discharge temperature during a heating operation of an air conditioner according to various embodiments of the disclosure.

The same reference numerals are used to represent the same elements throughout the drawings.

DETAILED DESCRIPTION

Figure 1:
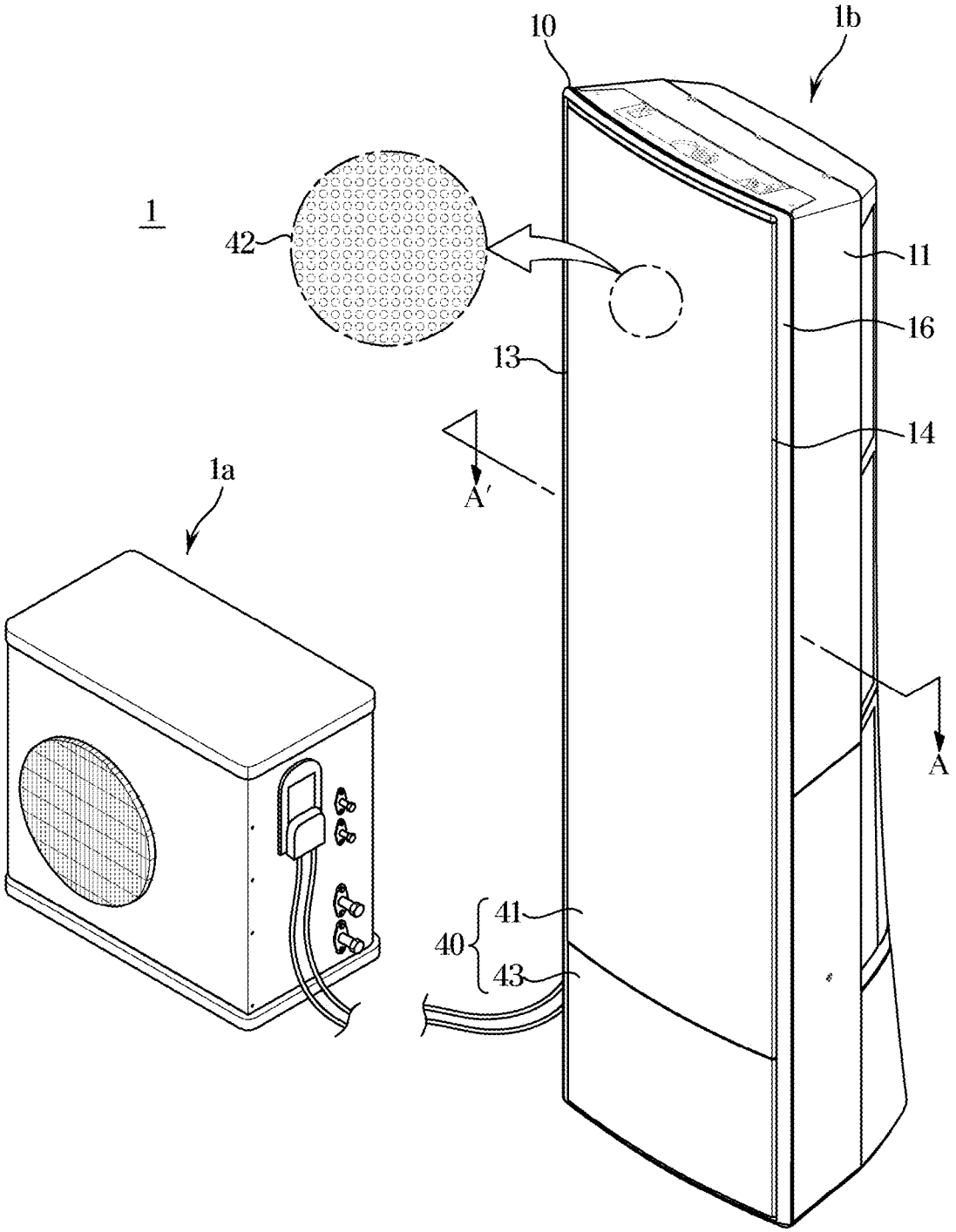
FIG. 1 is a view illustrating an appearance of an air conditioner according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In the following description, like reference numerals refer to like elements throughout the specification. Well-known functions or constructions are not described since they would obscure the one or more embodiments with unnecessary detail. Terms, such as "unit", "module", "member", and "block" may be embodied as hardware or software. According to embodiments of the disclosure, a plurality of "unit", "module", "member", and "block" may be implemented as a single component or a single "unit", "module", "member", and "block" may include a plurality of components.

It will be understood that when an element is referred to as being "connected" another element, it can be directly or indirectly connected to the other element, wherein the indirect connection includes "connection via a wireless communication network".

In addition, when a part "includes" or "comprises" an element, unless there is a particular description contrary thereto, the part may further include other elements, not excluding the other elements.

Throughout the description, when a member is "on" another member, this includes not only when the member is in contact with the other member, but also when there is another member between the two members.

It will be understood that, although the terms first, second, third, or the like, may be used herein to describe various elements, but is should not be limited by these terms. These terms are only used to distinguish one element from another element.

An identification code is used for the convenience of the description but is not intended to illustrate the order of each step. The each step may be implemented in the order different from the illustrated order unless the context clearly indicates otherwise.

Reference will now be made to embodiments of the disclosure, examples of which are illustrated in the accompanying drawings It should be appreciated that the blocks in each flowchart and combinations of the flowcharts may be performed by one or more computer programs which include computer-executable instructions. The entirety of the one or more computer programs may be stored in a single memory device or the one or more computer programs may be divided with different portions stored in different multiple memory devices.

Any of the functions or operations described herein can be processed by one processor or a combination of processors. The one processor or the combination of processors is circuitry performing processing and includes circuitry like an application processor (AP, e.g., a central processing unit (CPU)), a communication processor (CP, e.g., a modem), a graphical processing unit (GPU), a neural processing unit (NPU) (e.g., an artificial intelligence (AI) chip), a wireless-fidelity (Wi-Fi) chip, a Bluetooth™ chip, a global positioning system (GPS) chip, a near field communication (NFC) chip, connectivity chips, a sensor controller, a touch controller, a finger-print sensor controller, a display drive integrated circuit (IC), an audio CODEC chip, a universal serial bus (USB) controller, a camera controller, an image processing IC, a microprocessor unit (MPU), a system on chip (SoC), an IC, or the like.

FIG. 1 is a view illustrating an appearance of an air conditioner according to an embodiment of the disclosure.

Figure 2:
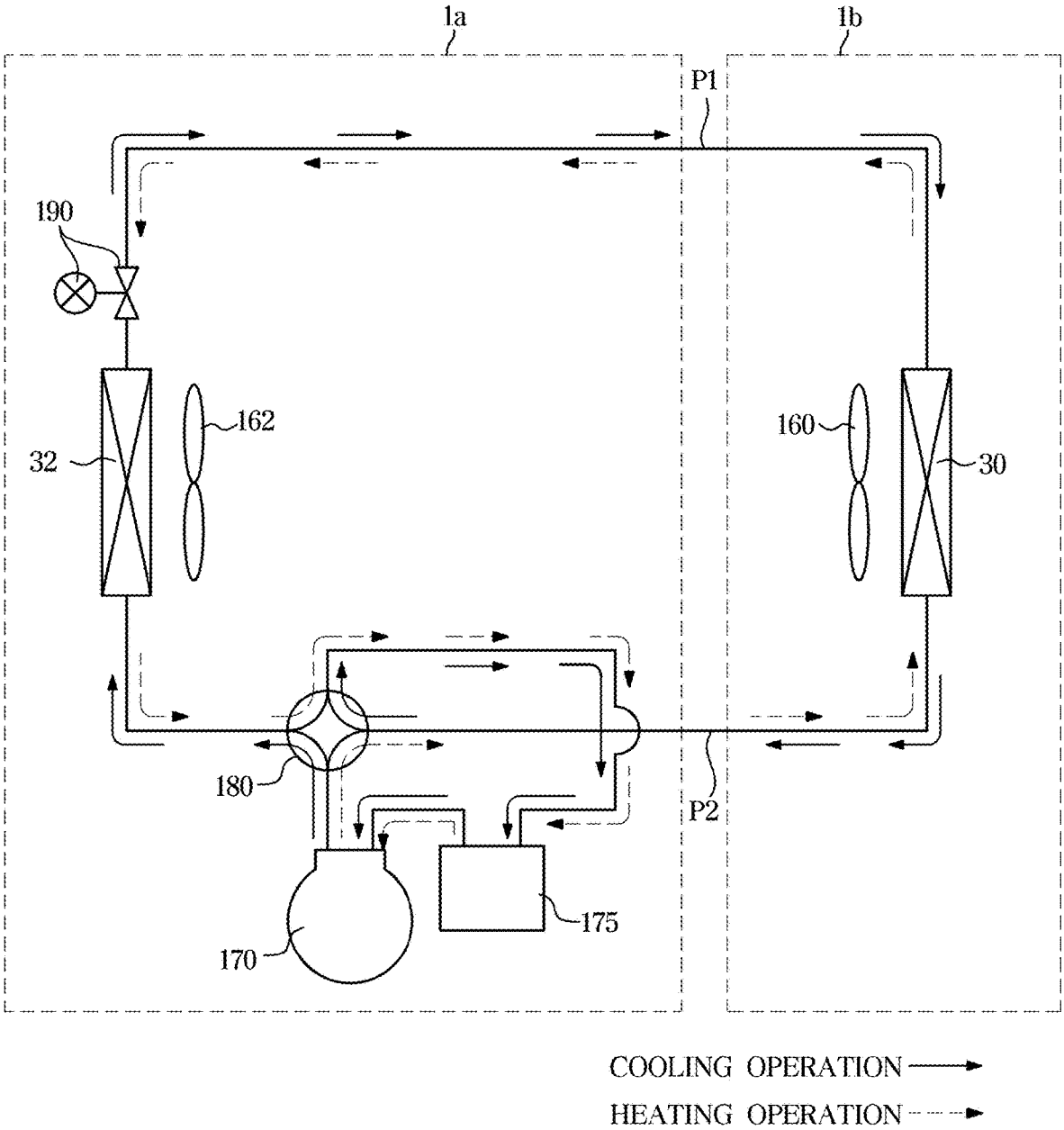
FIG. 2 illustrates a flow of refrigerant when an air conditioner performs a heating operation or cooling operation according to an embodiment of the disclosure.

FIG. 2 illustrates a flow of refrigerant when an air conditioner performs a heating operation or cooling operation according to an embodiment of the disclosure.

Figure 3:
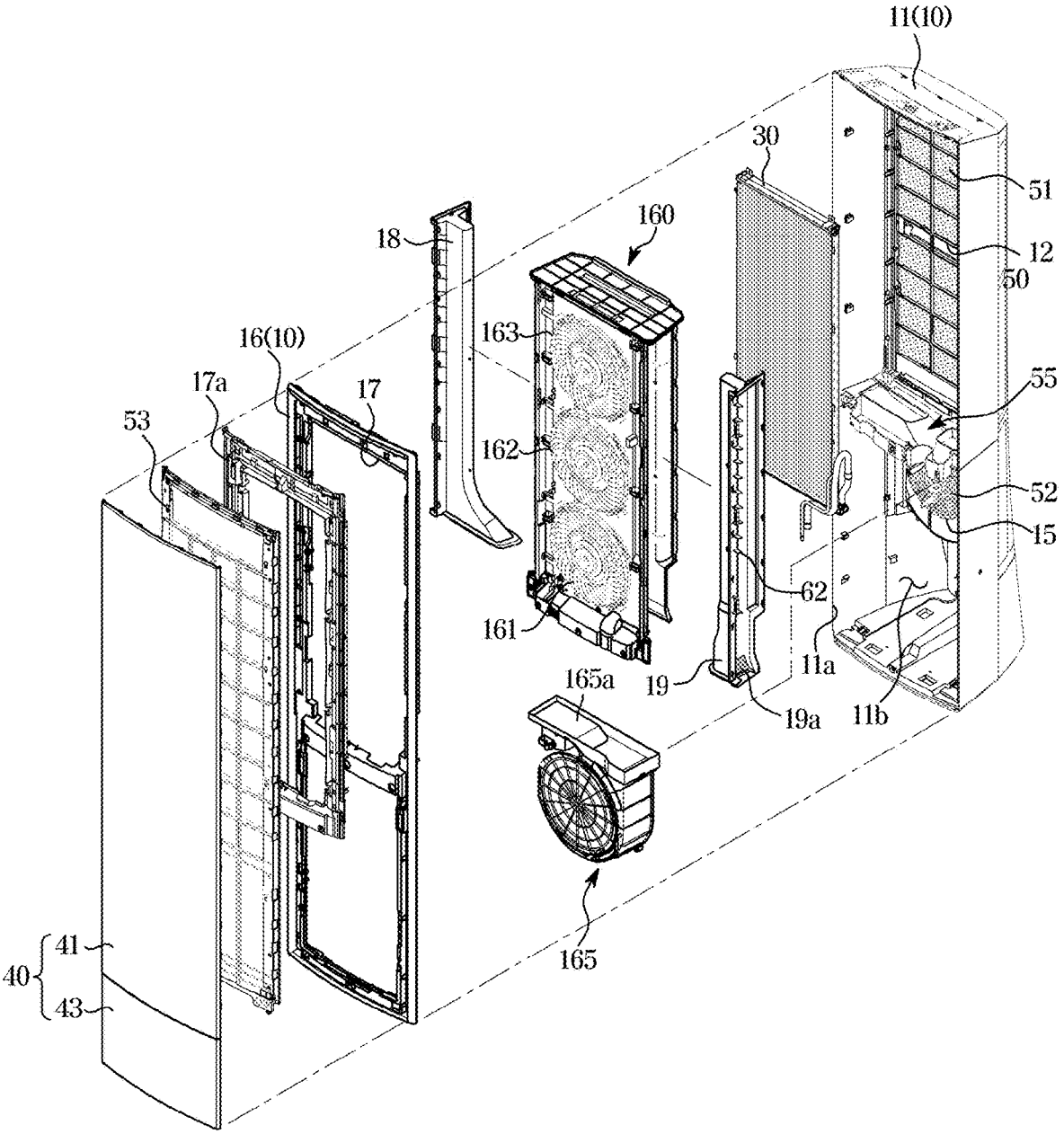
FIG. 3 is an exploded view of an air conditioner according to an embodiment of the disclosure.

FIG. 3 is an exploded view of an air conditioner according to an embodiment of the disclosure.

Figure 4:
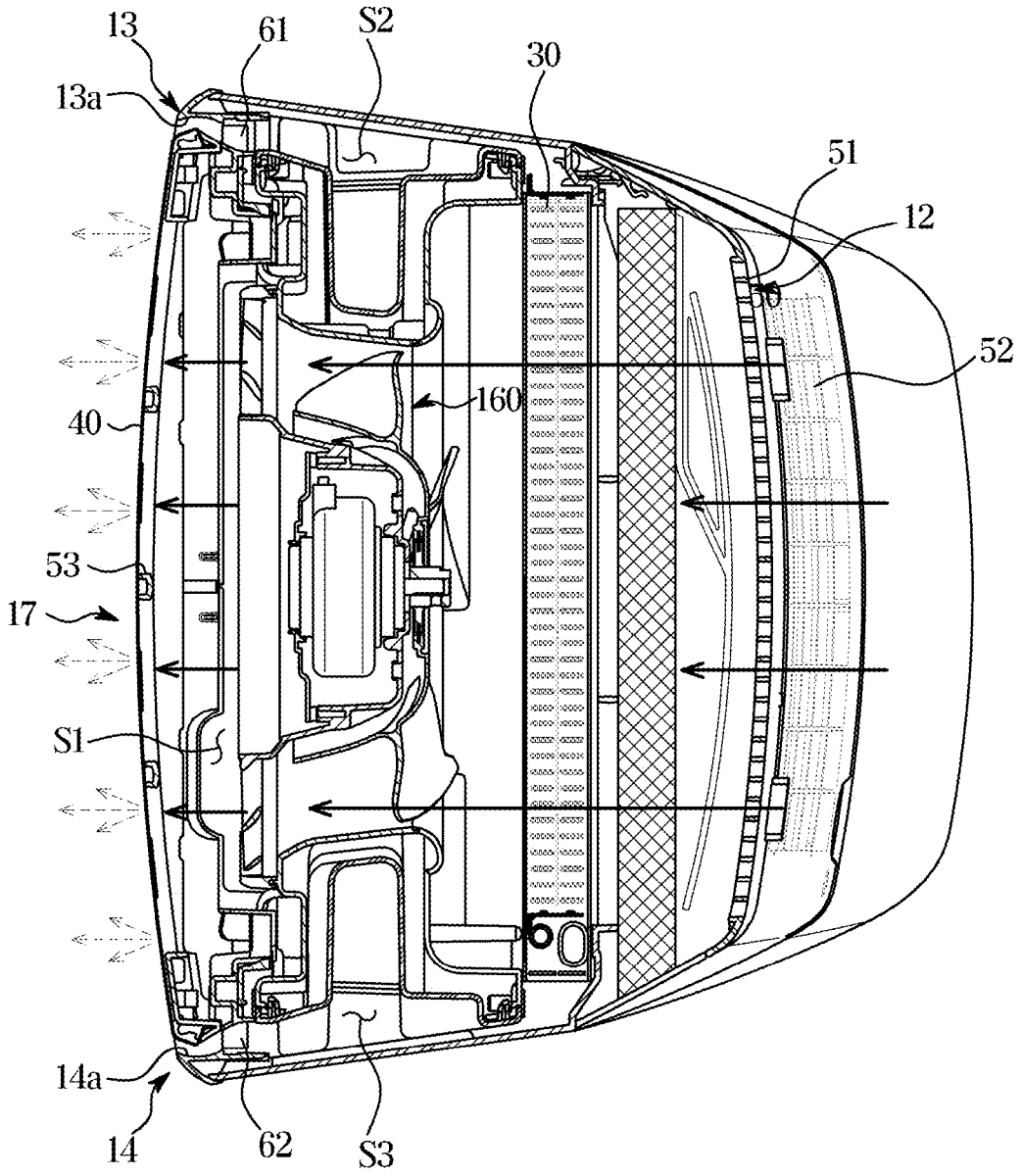
FIG. 4 is a cross-sectional view of an air conditioner illustrating a flow of air through a first flow path according to an embodiment of the disclosure.

FIG. 4 is a cross-sectional view of an air conditioner illustrating a flow of air through a first flow path according to an embodiment of the disclosure.

Figure 5:
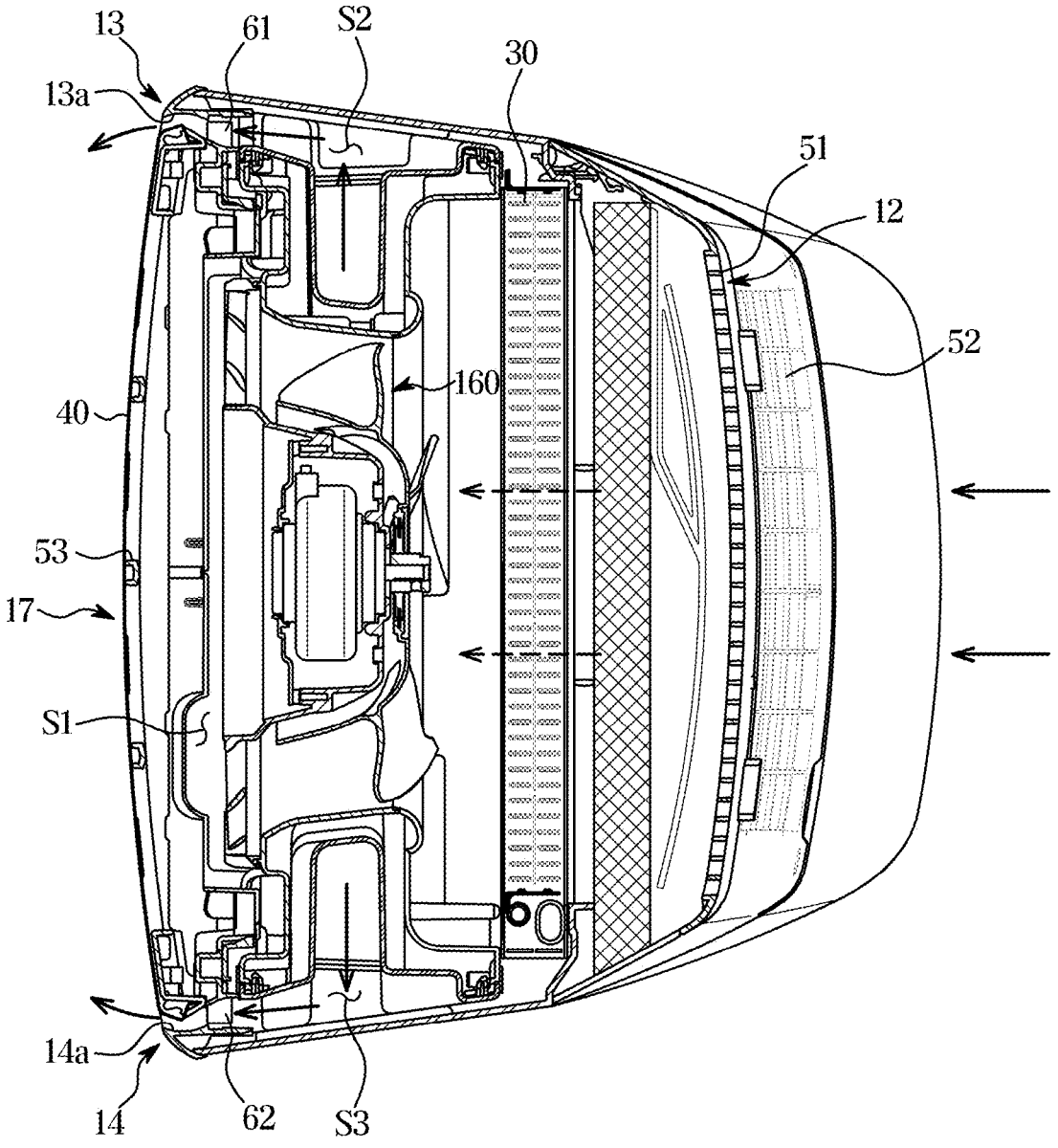
FIG. 5 is a cross-sectional view of an air conditioner illustrating a flow of air through a second flow path and a third flow path according to an embodiment of the disclosure.

FIG. 5 is a cross-sectional view of an air conditioner illustrating a flow of air through a second flow path and a third flow path according to an embodiment of the disclosure.

Referring to FIG. 1, an air conditioner 1 includes an outdoor unit 1*a* provided in an outdoor space to perform heat exchange between outdoor air and a refrigerant, and an indoor unit 1*b* provided in an indoor space to perform heat exchange between indoor air and a refrigerant. The outdoor unit 1*a* may be disposed outside an air conditioning space, and the indoor unit 1*b* may be disposed within the air conditioning space. The air conditioning space represents a space that is cooled or heated by the air conditioner 1. For example, the outdoor unit 1*a* may be placed outside a building, and the indoor unit 1*b* may be placed in a space separated from the outside by a wall, such as a living room or office.

Referring to FIG. 2, the air conditioner 1 includes a refrigerant flow path for circulating a refrigerant between the indoor unit 1*b* and the outdoor unit 1*a*. While the refrigerant circulates between the indoor unit 1*b* and the outdoor unit 1*a* along the refrigerant flow path, the refrigerant may absorb or release heat through a change in state (e.g., a state change from gas to liquid, or a state change from liquid to gas). The air conditioner 1 includes a liquid pipe P1 provided to connect the outdoor unit 1*a* and the indoor unit 2*b* and provided to serve as a passage through which liquid refrigerant flows, and a gas pipe P2 provided to serve as a passage through which a gaseous refrigerant flows. The liquid pipe P1 and the gas pipe P2 extend to the inside of the outdoor unit 1*a* and the indoor unit 1*b*.

The outdoor unit 1*a* includes a compressor 170 configured to compress a refrigerant, an outdoor heat exchanger 32 configured to perform heat exchange between outdoor air and the refrigerant, a four-way valve 180 configured to guide the refrigerant, which is compressed by the compressor 170, to the outdoor heat exchanger 32 or an indoor heat exchanger 30 based on a cooling operation or heating operation, an expansion valve 190 configured to depressurize the refrigerant, and an accumulator 175 configured to prevent a liquid refrigerant, which is not evaporated, from flowing into the compressor 170.

The compressor 170 may be operated by receiving electrical energy from an external power source. The compressor 170 includes a compressor motor (not shown) and compresses a low-pressure gaseous refrigerant to high pressure using a rotational force of the compressor motor.

The four-way valve 180 guides the refrigerant compressed by the compressor 170 to the outdoor heat exchanger 32 during the cooling operation, and guides the refrigerant compressed by the compressor 170 to the indoor unit 1*b* during the heating operation.

The outdoor heat exchanger 32 condenses the refrigerant compressed in the compressor 170 during the cooling operation, and evaporates the decompressed and condensed refrigerant in the indoor unit 1*b* during the heating operation. The outdoor heat exchanger 32 may include an outdoor heat exchanger refrigerant pipe (not shown) through which the refrigerant passes, and an outdoor heat exchanger cooling fin (not shown) provided to increase a surface area in contact with outdoor air. When the surface area in contact with the outdoor heat exchanger refrigerant pipe (not shown) and outdoor air is increased, heat exchange efficiency between the refrigerant and outdoor air may be improved.

An outdoor blowing fan 162 may be provided around the outdoor heat exchanger 32 to move outdoor air into the outdoor heat exchanger 32. The outdoor blowing fan 162 may blow outdoor air before heat exchange to the outdoor heat exchanger 32 and simultaneously blow the heat-exchanged air to the outdoor.

The expansion valve 190 may not only depressurize the refrigerant, but also adjust an amount of refrigerant provided to the outdoor heat exchanger 32 to ensure sufficient heat exchange in the outdoor heat exchanger 32. More particularly, the expansion valve 190 depressurizes the refrigerant by using throttling action of the refrigerant, in which the pressure decreases without heat exchange with the outside when the refrigerant passes through a narrow flow path. An electronic expansion valve (EEV) in which an opening degree is adjustable may be used to control the amount of refrigerant passing through the expansion valve 190.

The indoor unit 1*b* may include the indoor heat exchanger 30 and a blowing fan assembly 160. The indoor heat exchanger 30 performs heat exchange between indoor air and a refrigerant. The blowing fan assembly 160 may move indoor air into the indoor heat exchanger 30. The blowing fan assembly 160 may include a plurality of indoor blowing fans 161, 162, and 163.

The indoor heat exchanger 30 evaporates a low-pressure liquid refrigerant during the cooling operation, and condenses a high-pressure gaseous refrigerant during the heating operation. In the same manner as the outdoor heat exchanger 32 of the outdoor unit 1*a*, the indoor heat exchanger 30 includes an indoor heat exchanger refrigerant pipe (not shown) through which the refrigerant passes, and an indoor heat exchanger cooling fin (not shown) provided to increase heat exchange efficiency between the refrigerant and indoor air.

The blowing fan assembly 160 may be disposed around the indoor heat exchanger 30 to blow indoor air into the indoor heat exchanger 30. The indoor heat exchanger 30 may perform heat exchange with indoor air. The blowing fan assembly 160 may blow indoor air before heat exchange to the indoor heat exchanger 30 and simultaneously blow the heat-exchanged air into the indoor space.

During the cooling operation, the refrigerant may emit heat in the outdoor heat exchanger 32 and absorb heat in the indoor heat exchanger 30. For example, during the cooling operation, the refrigerant compressed in the compressor 170 may be first supplied to the outdoor heat exchanger 32 through the four-way valve 180 and then supplied to the indoor heat exchanger 30. In this case, the outdoor heat exchanger 32 may operate as a condenser that condenses the refrigerant, and the indoor heat exchanger 30 may operate as an evaporator that evaporates the refrigerant.

During the cooling operation, the high-temperature and high-pressure gaseous refrigerant discharged from the compressor 170 moves to the outdoor heat exchanger 32, and the liquid or near-liquid refrigerant condensed in the outdoor heat exchanger 32 expands and depressurizes in the expansion valve 190. The two-phase refrigerant passing through the expansion valve 190 moves to the indoor heat exchanger 30. The refrigerant flowing into the indoor heat exchanger 30 exchanges heat with air and evaporates. Accordingly, the temperature of the heat-exchanged air decreases and cold air is discharged to the outside of the indoor unit 1*b*.

During the heating operation, the refrigerant may emit heat in the indoor heat exchanger 30 and absorb heat in the outdoor heat exchanger 32. For example, during the heating operation, the refrigerant compressed in the compressor 170 may be first supplied to the indoor heat exchanger 30 through the four-way valve 180 and then supplied to the outdoor heat exchanger 32. In this case, the indoor heat exchanger 30 may operate as a condenser that condenses the refrigerant, and the outdoor heat exchanger 32 may operate as an evaporator that evaporates the refrigerant.

During the heating operation, the high-temperature and high-pressure gaseous refrigerant discharged from the compressor 170 moves to the indoor heat exchanger 30, and the high-temperature and high-pressure gaseous refrigerant passing through the indoor heat exchanger 30 exchanges heat with low-temperature dry air. The refrigerant condenses into a liquid or near-liquid refrigerant and releases heat, and as the air absorbs the heat, the warm air is discharged to the outside of the indoor unit 1*b*.

Hereinafter a structure of the indoor unit 1*b* will be described below.

Referring to FIGS. 1 and 3, the indoor unit 1*b* may include a housing 10 provided to form an appearance, the blowing fan assembly 160 configured to circulate air to the inside or outside of the housing 10, and the indoor heat exchanger 30 configured to exchange heat with air flowing into the housing 10. The housing 10 may also be referred to as 'indoor unit housing.'

The housing 10 may include a body case 11 on which the blowing fan assembly 160 and the indoor heat exchanger 30 are mounted, and a front panel 40 provided to cover a front surface of the body case 11. Further, the housing 10 may include a first inlet 12, a second inlet 15, a main outlet 17, and guide outlets 13 and 14.

The body case 11 may form rear, left, right, upper, and lower surfaces of the indoor unit 1*b*. The front surface of the body case 11 may be open, and the open front surface may form a body case opening 11*a*. The body case opening 11*a* may be covered by a first frame 16, a second frame 53, a support frame 17*a*, and the front panel 40.

The front panel 40 may be coupled to the housing 10 by the first frame 16. The front panel 40 may include a discharge area 41 including a plurality of holes 42 and a blocking area 43 in which the plurality of holes 42 is not formed. The plurality of holes 42 may penetrate the front panel 40. The plurality of holes 42 may be uniformly distributed over the entire area of the front panel 40. Heat-exchanged air passing through the main outlet 17 may be discharged to the outside of the housing 10 through the plurality of holes 42. A moving speed of the heat-exchanged air discharged through the plurality of holes 42 may be relatively less than a moving speed of the air discharged through the guide outlets 13 and 14. Because the hole is not provided in the blocking area 43, air may not pass through the blocking area 43.

The first frame 16 may be coupled to a front surface of the body case 11, that is, the body case opening 11*a*. The second frame 53 may be coupled to a front surface of the first frame 16. The support frame 17*a* may be disposed between the first frame 16 and the second frame 53 and support the first frame 16 and the second frame 53. The first frame 16 and the front panel 40 may be separable from the body case 11.

The first frame 16 may include the main outlet 17. The main outlet 17 may be disposed on the front side of the housing 10. The main outlet 17 may penetrate the first frame 16. The main outlet 17 may be formed in an upper portion of the first frame 16. The main outlet 17 may be arranged to face the first inlet 12. The air that is heat exchanged inside the housing 10 may be discharged to the outside of the housing 10 through the main outlet 17. The main outlet 17 may discharge air that is introduced through the first inlet 12.

The support frame 17*a* supporting the front panel 40 may be coupled to a portion of the first frame 16 in which the main outlet 17 is formed. The support frame 17*a* may extend along a circumference of the main outlet 17. The support frame 17*a* may support a rear surface of the front panel 40.

The first inlet 12 formed in the body case 11 may penetrate the rear surface of the body case 11. The first inlet 12 may be formed in an upper portion of the rear surface of the body case 11. External air may flow into an inside of the housing 10 through the first inlet 12.

At least one first inlet 12 may be provided or a plurality of first outlet 12 may be provided according to the design. A shape of the first inlet 12 may be quadrangle. The first inlet 12 may be provided in various shapes according to the design.

The second inlet 15 may penetrate the rear surface of the body case 11 and may be formed in a lower portion of the rear surface of the body case 11. The second inlet 15 may be formed below the first inlet 12. External air may flow into the inside of the housing 10 through the second inlet 15. The number and shape of the second inlets 15 may be provided in various ways according to the design.

The first frame 16 may form the guide outlets 13 and 14 together with the front panel 40. The guide outlets 13 and 14 may be formed on the same side as the main outlet 17. The guide outlets 13 and 14 may be disposed adjacent to the main outlet 17. The guide outlets 13 and 14 may be arranged to be spaced apart from the main outlet 17 by a predetermined distance. The guide outlets 13 and 14 may be formed on the left and/or right sides of the main outlet 17. The guide outlets 13 and 14 may include a first guide outlet 13 disposed on the left side of the main outlet 17 and a second guide outlet 14 disposed on the right side of the main outlet 17.

The guide outlets 13 and 14 may extend along a vertical direction of the body case 11. The guide outlets 13 and 14 may have the same length as the main outlet 17. Air that is not heat-exchanged inside the housing 10 may be discharged to the outside of the housing 10 through the guide outlets 13 and 14. The guide outlets 13 and 14 may discharge air that is introduced through the second inlet 15.

Referring to FIGS. 4 and 5, the guide outlets 13 and 14 may be configured to mix the air discharged from the guide outlets 13 and 14 with the air discharged from the main outlet 17. More particularly, a portion of the first frame 16 forming the guide outlets 13 and 14 may include guide curved portions 13*a* and 14*a* provided to guide air, which is discharged from the guide outlets 13 and 14, to allow the air, which is discharged from the guide outlets 13 and 14, to mix with air discharged from the main outlet 17.

Air discharged through the guide outlets 13 and 14 may be discharged along the guide curved portions 13*a* and 14*a* to a direction of being mixed with air discharged from the main outlet 17. The guide curved portions 13*a* and 14*a* may guide the air discharged through the guide outlets 13 and 14 to be discharged in approximately the same direction as the air discharged through the main outlet 17. The guide curved portions 13*a* and 14*a* may be provided to guide the air discharged through the guide outlets 13 and 14 to the front side.

Blades 61 and 62 provided to guide air discharged through the guide outlets 13 and 14 may be disposed on the guide outlets 13 and 14. The blades 61 and 62 may be continuously disposed along a longitudinal direction of the guide outlets 13 and 14. A first blade 61 may be disposed at the first guide outlet 13, and a second blade 62 may be disposed at the second guide outlet 14.

A flow path provided to connect the first inlet 12 and the main outlet 17 is referred to as a first flow path S1, a flow path provided to connect the second inlet 15 and the first guide outlet 13 is referred to as a second flow path S2, and a flow path provided to connect the second inlet 15 and the second guide outlet 14 is referred to as a third flow path S3. The first flow path S1 may be divided into the second flow path S2 and the third flow path S3. Air flowing along the first flow path S1 inside the indoor unit 1*b* may not be mixed with air flowing along the second flow path S2 and the third flow path S3 inside the indoor unit 1*b*. Some sections of the second flow path S2 and the third flow path S3 may overlap. In the second flow path S2 and the third flow path S3, a section from the second inlet 15 to a circulation fan 165 may be shared.

Referring to FIG. 3, a first duct 18 provided to define the first flow path S1 and the second flow path S2 may be disposed inside the housing 10. The first duct 18 may be disposed on the left side of the blowing fan assembly 160. The first duct 18 may extend along the vertical direction. The first duct 18 may communicate with the circulation fan 165. The first duct 18 may communicate with a fan outlet 165*a* of the circulation fan 165. The first duct 18 may guide a portion of the air flowing by the circulation fan 165 to the first guide outlet 13. A first duct filter (not shown) may be provided in the first duct 18 to filter out foreign substances in the air flowing from the circulation fan 165.

A second duct 19 provided to define the first flow path S1 and the third flow path S3 may be disposed inside the housing 10. The second duct 19 may be disposed on the right side of the blowing fan assembly 160. The second duct 19 may extend along the vertical direction. The second duct 19 may communicate with the circulation fan 165. The second duct 19 may communicate with the fan outlet 165*a* of the circulation fan 165. The second duct 19 may guide a portion of the air flowing by the circulation fan 165 to the second guide outlet 14. A second duct filter 19*a* may be provided in the second duct 19 to filter out foreign substances in the air flowing from the circulation fan 165.

Air heat-exchanged with the indoor heat exchanger 30 may be discharged through the main outlet 17, and air not passing through the indoor heat exchanger 30 may be discharged through the guide outlets 13 and 14. For example, the guide outlets 13 and 14 may be provided to discharge air that is not heat exchanged. Because the indoor heat exchanger 30 is disposed on the first flow path S1, the air discharged through the main outlet 17 may be heat-exchanged air. Because the indoor heat exchanger 30 is not disposed on the second flow path S2 and the third flow path S3, the air discharged through the guide outlets 13 and 14 may be air that is not heat-exchanged.

According to another embodiment of the disclosure, heat exchangers (not shown) may also be disposed on the second flow path S2 and the third flow path S3. For example, a heat exchanger (not shown) may be provided in an accommodating space 11*b* of the body case 11. When the heat exchanger (not shown) is also disposed on the second flow path S2 and the third flow path S3, heat-exchanged air may be discharged through the guide outlets 13 and 14.

Electrical components (not shown) may be disposed in the accommodating space 11*b* of the body case 11. For example, a driving circuit and/or a control circuit required for driving the air conditioner 1 may be disposed. Further, the circulation fan 165 may be disposed in the accommodating space 11*b*.

The circulation fan 165 may be driven independently of the blowing fan assembly 160. A rotational speed of the circulation fan 165 may be different from a rotational speed of each of the plurality of blowing fans 161, 162, and 163 included in the blowing fan assembly 160.

The blowing fan assembly 160 may be disposed on the first flow path S1 extending from the first inlet 12 to the main outlet 17. By the operation of the blowing fan assembly 160, air may be introduced into the inside of the housing 10 through the first inlet 12. Air introduced through the first inlet 12 may move along the first flow path S1 and be discharged to the outside of the housing 10 through the main outlet 17.

The blowing fan assembly 160 may include at least one blowing fan. For example, the blowing fan assembly 160 may include a first blowing fan 161, a second blowing fan 162, and a third blowing fan 163. FIG. 3 illustrates that three blowing fans 161, 162, and 163 are provided, but the blowing fan assembly 160 may include two blowing fans, and may include various numbers of blowing fans according to the design.

The first blowing fan 161, the second blowing fan 162, and the third blowing fan 163 may be arranged in the vertical direction of the indoor unit housing 10. In the blowing fan assembly 160, the first blowing fan 161 may be disposed at the bottom, the third blowing fan 163 may be disposed at the top, and the second blowing fan 162 may be disposed between the first blowing fan 161 and the second blowing fan 162. The first blowing fan 161, the second blowing fan 162, and the third blowing fan 163 may have the same structure.

The blowing fans 161, 162, and 163 may each include an axial fan or a diagonal fan. In addition, the blowing fans 161, 162, and 163 may include various shapes and/or types of fans that is configured to discharge air, which flows from the outside of the housing 10, back to the outside of the housing 10. For example, the blowing fans 161, 162, and 163 may be cross fans, turbo fans, or sirocco fans.

The circulation fan 165 may be disposed on the second flow path S2 and the third flow path S3 extending from the second inlet 15 to the guide outlets 13 and 14. Air may be introduced into the inside of the housing 10 through the second inlet 15 by the circulation fan 165. A portion of the air introduced through the second inlet 15 may move along the second flow path S2 and be discharged to the outside of the housing 10 through the first guide outlet 13 or moves along the third flow path S3 and be discharged to the outside of the housing 10 through the second guide outlet 14.

The indoor heat exchanger 30 may be disposed between the blowing fan assembly 160 and the first inlet 12. The indoor heat exchanger 30 may be disposed on the first flow path S1. The indoor heat exchanger 30 may absorb heat from air introduced through the first inlet 12 or transfer heat to the air introduced through the first inlet 12. The indoor heat exchanger 30 may include a tube and a header coupled to the tube. However, the type of indoor heat exchanger 30 is not limited thereto.

The indoor unit 1*b* may include a first intake grille 51 coupled to a portion of the body case 11 in which the first inlet 12 is formed. The first intake grille 51 may be provided to prevent foreign substances from entering through the first inlet 12. To this, the first intake grille 51 may include a plurality of slits or holes. The first intake grille 51 may be provided to cover the first inlet 12.

The indoor unit 1*b* may include a second intake grille 52 coupled to a portion of the body case 11 in which the second inlet 15 is formed. The second intake grille 52 may be provided to prevent foreign substances from entering through the second inlet 15. To this, the second intake grille 52 may include a plurality of slits or holes. The second intake grille 52 may be provided to cover the second inlet 15.

The indoor unit 1*b* may include the second frame 53 coupled to a portion of the first frame 16. The second frame 53 may be mounted on the support frame 17*a*. The second frame 53 may be provided to prevent foreign substances from being discharged through the main outlet 17. To this, the second frame 53 may include a plurality of slits or holes. The second frame 53 may be provided to cover the main outlet 17.

The indoor unit 1*b* may include a distribution device 55. The distribution device 55 may be disposed inside the housing 10. For example, the distribution device 55 may be disposed in the accommodating space 11*b* of the body case 11. The distribution device 55 may be disposed adjacent to the fan outlet 165*a* of the circulation fan 165. The distribution device 55 may be disposed in a portion in which air, which is introduced through the second inlet 15, is branched into the first guide outlet 13 and the second guide outlet 14. The distribution device 55 may be arranged between the first inlet 12 and the second inlet 15. The distribution device 55 may be configured to distribute air blown by the circulation fan 165 to the first duct 18 and the second duct 19. The distribution device 55 may be configured to adjust a flow rate of air discharged through the first guide outlet 13 and the second guide outlet 14.

Referring to FIG. 4, the air conditioner 1 may be driven in a first mode that discharges heat-exchanged air through the main outlet 17. In the first mode, external air may be introduced into the inside of the housing 10 through the first inlet 12 by the operation of the blowing fan assembly 160, and the introduced air may be heat-exchanged while passing through the indoor heat exchanger 30. The heat exchanged air may be discharged to the outside of the housing 10 through the main outlet 17. A wind speed of the heat-exchanged air may be reduced while the heat-exchanged air passes through the plurality of holes 42 of the front panel 40. According to this configuration, it is possible to cool or heat the indoor space at a wind speed that a user feels comfortable with. In the first mode, because the circulation fan 165 is not operated, air may not be discharged through the guide outlets 13 and 14.

Referring to FIG. 5, the air conditioner 1 may be driven in a second mode in which air that is not heat-exchanged is discharged through the guide outlets 13 and 14. Because the heat exchanger is not disposed on the second flow path S2 and the third flow path S3, the indoor unit 1*b* may circulate indoor air. Because the guide outlets 13 and 14 are provided with the guide curved portions 13*a* and 14*a*, the air discharged through the guide outlets 13 and 14 may be discharged toward the front of the indoor unit 1*b*. Because the blades 61 and 62 are provided on the guide outlets 13 and 14, the air may be blown farther forward.

As the circulation fan 165 is driven, air outside the housing 10 may be introduced into the inside of the housing 10 through the second inlet 15. The air introduced into the housing 10 may pass through the circulation fan 165 and then move to the second flow path S2 and the third flow path S3 formed on both sides of the first flow path S1, respectively. The air may move upward on the second flow path S2 and the third flow path S3 and then be discharged to the outside of the housing 10 through the guide outlets 13 and 14. At this time, the air may be guided to the front of the air conditioner 1 along the guide curved portions 13*a* and 14*a*.

Because the blowing fan assembly 160 is not driven in the second mode, air is not discharged through the main outlet 17. For example, in the second mode, the air conditioner 1 may blow air that is not heat exchanged, and thus the air conditioner 1 may simply perform the function of circulating indoor air.

Further, the air conditioner 1 may be driven in a third mode in which heat-exchanged air is discharged through the main outlet 17 and air, which is not heat-exchanged, is discharged through the guide outlets 13 and 14. The air conditioner 1 may move cold or warm air farther when driven in the third mode than when driven in the first mode.

When the air conditioner 1 is driven in the third mode, cold or warm air discharged through the main outlet 17 may be mixed with air discharged through the guide outlets 13 and 14. In addition, the air discharged through the guide outlets 13 and 14 may move at a relatively faster speed than the heat-exchanged air discharged through the main outlet 17. The air discharged through the guide outlets 13 and 14 may move farther than the heat-exchanged air discharged through the main outlet 17. According to this configuration, the air conditioner 1 may provide a user with comfortable cold or warm air in which heat-exchanged air is mixed with indoor air.

Figure 6:
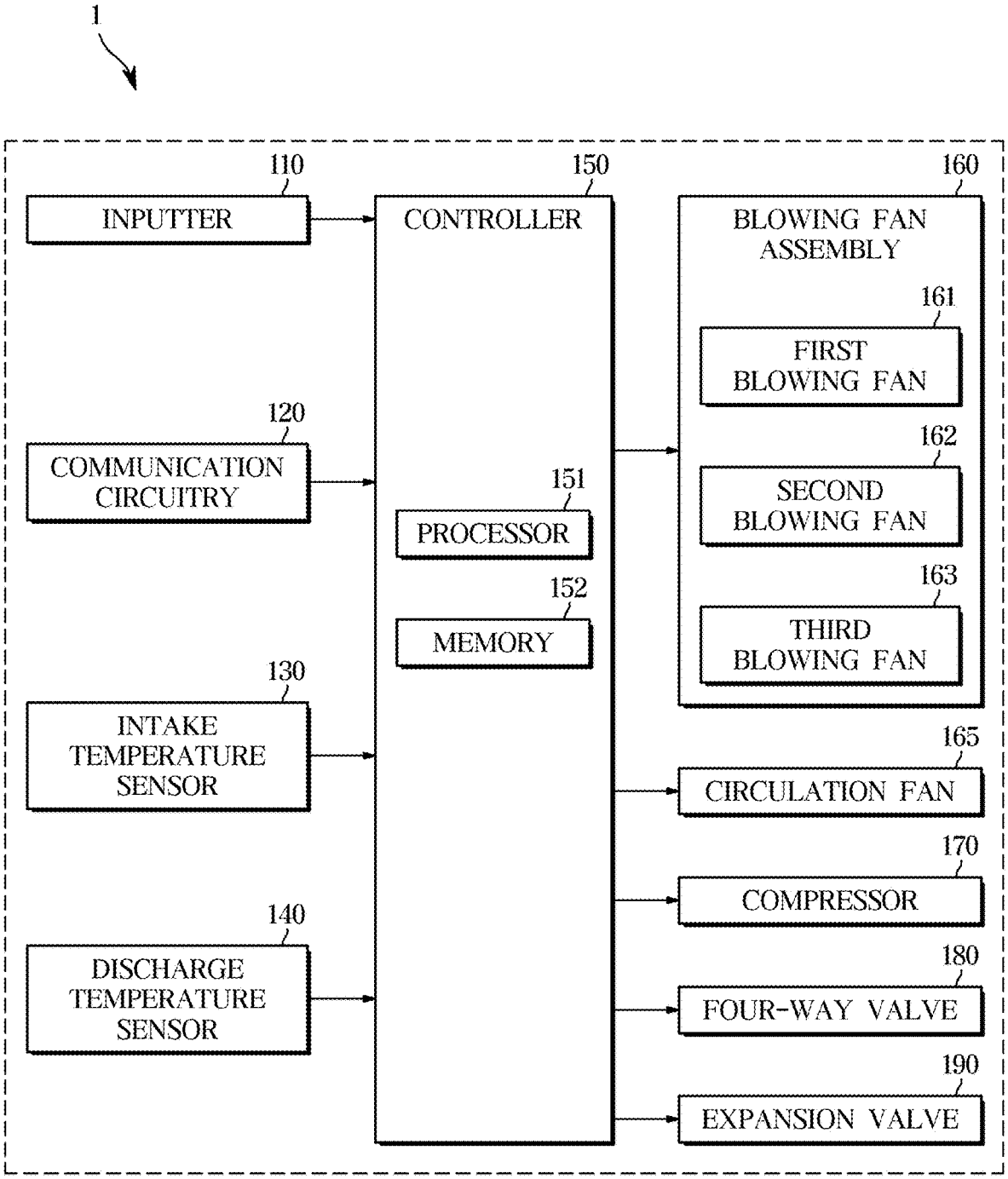
FIG. 6 is a control block diagram of an air conditioner according to an embodiment of the disclosure.

FIG. 6 is a control block diagram of an air conditioner according to an embodiment of the disclosure.

Referring to FIG. 6, the air conditioner 1 may include an inputter 110, a communication circuitry 120, an intake temperature sensor 130, a discharge temperature sensor 140, a controller 150, the blowing fan assembly 160, the circulation fan 165, the compressor 170, the four-way valve 180, and the expansion valve 190.

The inputter 110, the communication circuitry 120, the intake temperature sensor 130, the discharge temperature sensor 140, the controller 150, and the blowing fan assembly 160 may be provided in the indoor unit 1*b*. Further, the indoor unit 1*b* may include the circulation fan 165. The compressor 170, the four-way valve 180, and the expansion valve 190 may be included in the outdoor unit 1*a*. The controller 150 may be electrically connected to the components of the air conditioner 1 and may control the operation of each component. The outdoor unit 1*a* may also include a processor.

The inputter 110 may obtain a user input related to the operation of the air conditioner 1 from a user. Additionally, the inputter 110 may transmit an electrical signal (voltage or current) corresponding to the user input to the controller 150. The controller 150 may control the operation of the air conditioner 1 based on the electrical signal transmitted from the inputter 110.

The inputter 110 may include a plurality of buttons provided on the housing 10 of the indoor unit 1*b*. For example, the inputter 110 may include an operation mode button to select the cooling operation or the heating operation, a temperature button to set a target temperature of the indoor space (conditioning space), a wind direction button to set a wind direction, and/or an air volume button to set an intensity of wind (rotational speed of fan).

The inputter 110 may receive an input from a user to select the cooling operation or the heating operation, and may receive an input of a target temperature desired by a user during the cooling operation or the heating operation. The controller 150 may perform compressor capacity control according to the target temperature input from the inputter 110, and control the compressor 170 according to various embodiments described later.

The communication circuitry 120 may communicate with an access point (AP) (not shown) provided separately in the air conditioning space, and may be connected to the network through the access point. The communication circuitry 120 may communicate with a user terminal device (e.g., a smartphone) through the access point. The communication circuitry 120 may receive information on a user terminal device connected to the access point and transmit the information on the user terminal device to the controller 150. Further, the communication circuitry 120 may receive location information (e.g., a global positioning system (GPS) signal) of the user terminal device from the user terminal device, and may transmit the received location information to the controller 150. For this, the communication circuitry 120 may include a known wired communication module or a wireless communication module.

The intake temperature sensor 130 and the discharge temperature sensor 140 may be provided at each of various positions of the air conditioner 1.

The intake temperature sensor 130 may measure an intake temperature. The intake temperature refers to a temperature of indoor air drawn into the indoor heat exchanger 30. The intake temperature sensor 130 may be disposed in a position for measuring a temperature of the indoor space in which the indoor unit 1*b* is disposed, and in a position for measuring a temperature of air flowing into the first inlet 12 and the second inlet 15 (refer to FIG. 3). An electrical signal measured by the intake temperature sensor 130 is transmitted to the controller 150 and used for the compressor capacity control based on the comparison with the target temperature.

The discharge temperature sensor 140 may measure a temperature of air discharged from the indoor unit 1*b*. The discharge temperature sensor 140 may measure a temperature of air that is heat-exchanged while passing through the indoor heat exchanger 30. In order to measure a temperature of air discharged to the indoor space after being heat-exchanged through the indoor heat exchanger 30, the discharge temperature sensor 140 may be disposed on the front panel 40 or the main outlet 17 of the housing 10 of the indoor unit or disposed in a portion of the indoor heat exchanger 30 (e.g., the front surface of the indoor heat exchanger 30) (refer to FIG. 3). An electrical signal measured by the discharge temperature sensor 140 is transmitted to the controller 150 and used for the compressor capacity control based on the comparison with a reference temperature.

In addition to the intake temperature sensor 130 and the discharge temperature sensor 140, a separate temperature sensor (not shown) may be disposed on the indoor heat exchanger 30 to detect a condensation temperature of the condensed refrigerant.

The above-mentioned temperature sensors may include a thermistor in which an electrical resistance value changes according to temperature.

The controller 150 may include memory 152 configured to memorize and/or store programs, instructions, and data for controlling the operation of the air conditioner 1, and a processor 151 configured to generate a control signal for controlling the operation of the air conditioner 1 based on programs, instructions and data memorized and/or stored in the memory 152. The controller 150 may be implemented as a control circuit in which the processor 151 and the memory 152 are mounted. Alternatively, the controller 150 may include a plurality of processors and a plurality of memories.

The memory 152 may memorize/store various information required for the operation of the air conditioner 1. The memory 152 may store instructions, applications, data, and/or programs required for the operation of the air conditioner 1.

The memory 152 may include volatile memory, such as static random access memory (S-RAM) and dynamic random access memory (D-RAM) for temporarily storing data, and non-volatile memory, such as read only memory (ROM), erasable programmable read only memory (EPROM), and electrically erasable programmable read only memory (EEPROM) for long-term storage of data.

The processor 151 may generate a control signal for controlling the operation of the air conditioner 1 based on instructions, applications, data, and/or programs stored in the memory 152. The processor 151 may be hardware and may include a logic circuit and arithmetic circuit. The processor 151 may process data according to programs and/or instructions provided from the memory 152 and generate control signals according to the processing results. The memory 152 and the processor 151 may be implemented as one control circuit or as a plurality of circuits.

In response to a control signal from the controller 150, the compressor 170 may circulate the refrigerant on the refrigerant circulation circuit including the compressor 170, the four-way valve 180, the outdoor heat exchanger 32, the expansion valve 190, and the indoor heat exchanger 30. More particularly, the compressor 170 may compress a gaseous refrigerant and discharge a high-temperature/high-pressure gaseous refrigerant. Further, the compressor 170 may be not operated in a blowing operation that does not require cooling or heating.

The compressor 170 may include a constant speed compressor in which compression capacity is kept constant and/or an inverter compressor in which compression capacity is variable. When the compressor 170 is the inverter compressor, the controller 150 may adjust an operating frequency based on the intake temperature and/or discharge temperature. At this time, the controller 150 may perform fuzzy control to periodically adjust the operating frequency of the compressor 170 to allow a temperature of the air cooled by the indoor heat exchanger 30 to follow the target temperature. Fuzzy control may determine an adjustment value for the operating frequency using a pre-stored fuzzy table. The controller 150 may determine an amount of increase or decrease of the operating frequency by referring to the fuzzy table.

The four-way valve 180 may switch a circulation direction of the refrigerant discharged from the compressor 170 under the control of the controller 150. More particularly, the four-way valve 180 guides the refrigerant compressed in the compressor 170 to the outdoor heat exchanger 32 during the cooling operation, and guides the refrigerant compressed in the compressor 170 to the indoor heat exchanger 30 during the heating operation.

The expansion valve 190 may depressurize the refrigerant. Further, the expansion valve 190 may adjust an amount of refrigerant supplied to ensure sufficient heat exchange in the outdoor heat exchanger 32 or the indoor heat exchanger 30. The expansion valve 190 depressurizes the refrigerant by using the throttling action of the refrigerant, in which the pressure decreases as the refrigerant passes through a narrow flow path. The expansion valve 190 may be implemented as an electric expansion valve in which an opening amount is controlled by an electrical signal.

The blowing fan assembly 160 may include the plurality of blowing fans 161, 162, and 163. The plurality of blowing fans 161, 162, and 163 may move air heat-exchanged in the indoor heat exchanger 30 to the outside of the indoor unit 1*b*. As the blowing fan assembly 160 is driven, external air may be introduced into the housing 10 through the first inlet 12. The air introduced into the housing 10 passes through the indoor heat exchanger 30 and exchanges heat with the refrigerant flowing through the indoor heat exchanger 30. The air that is heat exchanged by the indoor heat exchanger 30 may pass through the blowing fan assembly 160, and be discharged to the outside of the housing 10 through the main outlet 17 of the first frame 16 and the plurality of holes 42 of the front panel 40.

The plurality of blowing fans 161, 162, and 163 included in the blowing fan assembly 160 may operate under the control of the controller 150. Each of the plurality of blowing fans 161, 162, and 163 may include a fan motor and may rotate using power generated by the fan motor. The plurality of blowing fans 161, 162, and 163 may operate during the cooling or the heating operation.

The circulation fan 165 may introduce external air into the indoor unit housing 10 and discharge the introduced air to the outside of the indoor unit 1*b* through the guide outlets 13 and 14. By operating the circulation fan 165, air may be introduced into the inside of the housing 10 through the second inlet 15. A portion of the air introduced through the second inlet 15 may move along the second flow path S2 and be discharged to the outside of the housing 10 through the first guide outlet 13 or move along the third flow path S3 and be discharged to the outside of the housing 10 through the second guide outlet 14.

The circulation fan 165 may operate under the control of the controller 150. The circulation fan 165 may include a fan motor and may rotate using power generated by the fan motor. For example, the circulation fan 165 may operate during the cooling or the heating operation. The circulation fan 165 may operate even during the blowing operation when cooling and heating are not required.

In the above, the configuration of the air conditioner 1 according to the disclosure and the operations of each configuration are described. Hereinafter the compressor capacity control performed during the cooling or heating operation will be described based on the above-described configurations.

The reference temperature described in the following description refers to a predetermined temperature for controlling the compressor 170 in relation to the discharge temperature. The reference temperature is a different concept from the target temperature and may correspond to the lower or upper limit of the temperature of air discharged after heat exchange during the cooling or heating operation. The reference temperature may correspond to a value determined according to the performance of the air conditioner 1 and may have various values according to the size of the indoor unit 1*b*, the size of the indoor heat exchanger 30, and the blowing capacity of the blowing fan assembly 160. The air conditioner 1, which is configured to simultaneously perform cooling and heating, may have separate cooling and heating reference temperatures. For example, the cooling reference temperature may be about 8° C., and the heating reference temperature may be about 40° C. As described above, each of the cooling reference temperature and the heating reference temperature may have various values according to the performance of each component of the air conditioner 1.

First operating frequency to fourth operating frequency described in FIGS. 7 to 14 are used to distinguish different operating frequencies within the scope of one embodiment of the disclosure, and do not mean related values.

Figure 7:
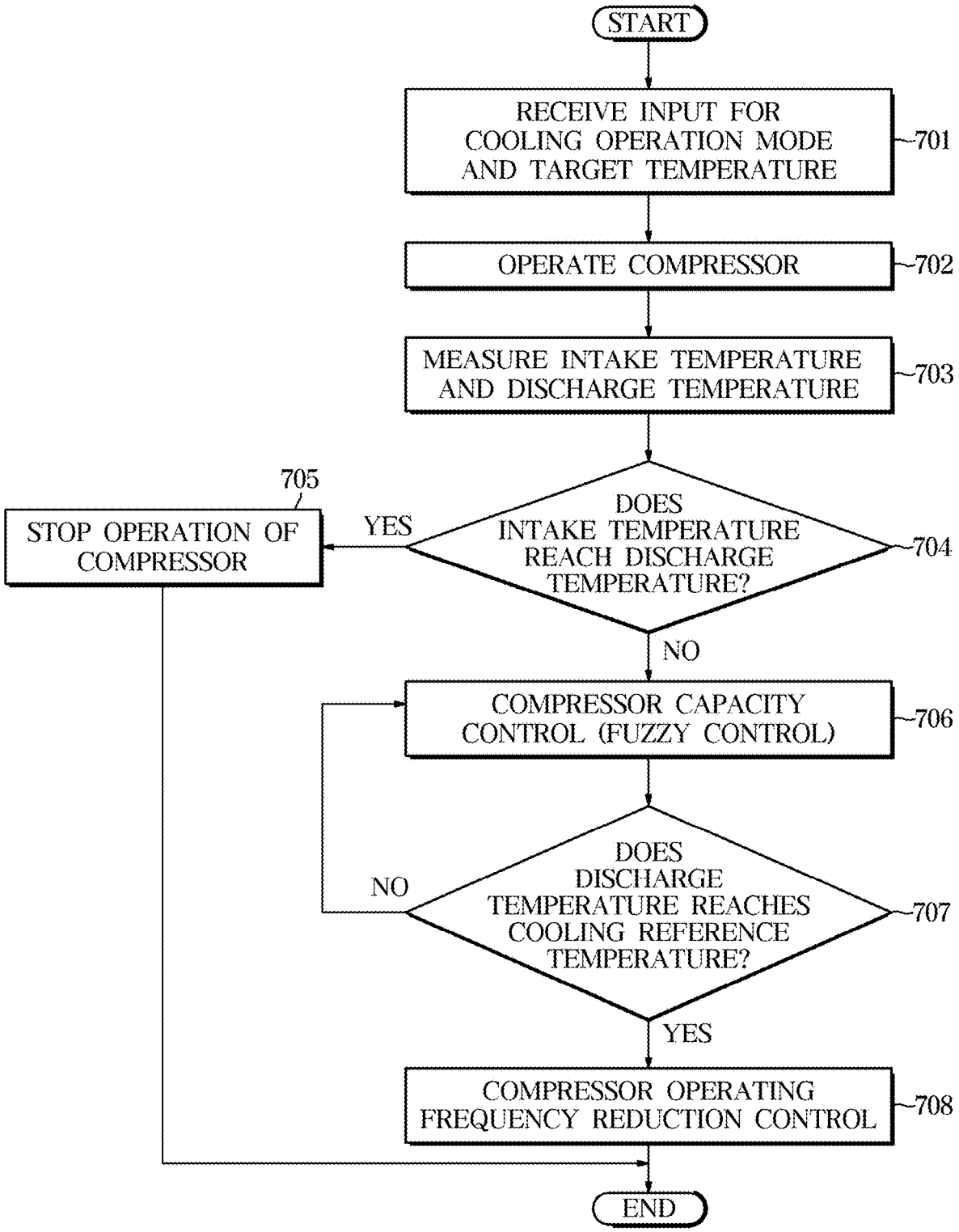
FIG. 7 is a flowchart of a control method of an air conditioner according to an embodiment of the disclosure.

FIG. 7 is a flowchart of a control method of an air conditioner according to an embodiment of the disclosure.

Figure 8:
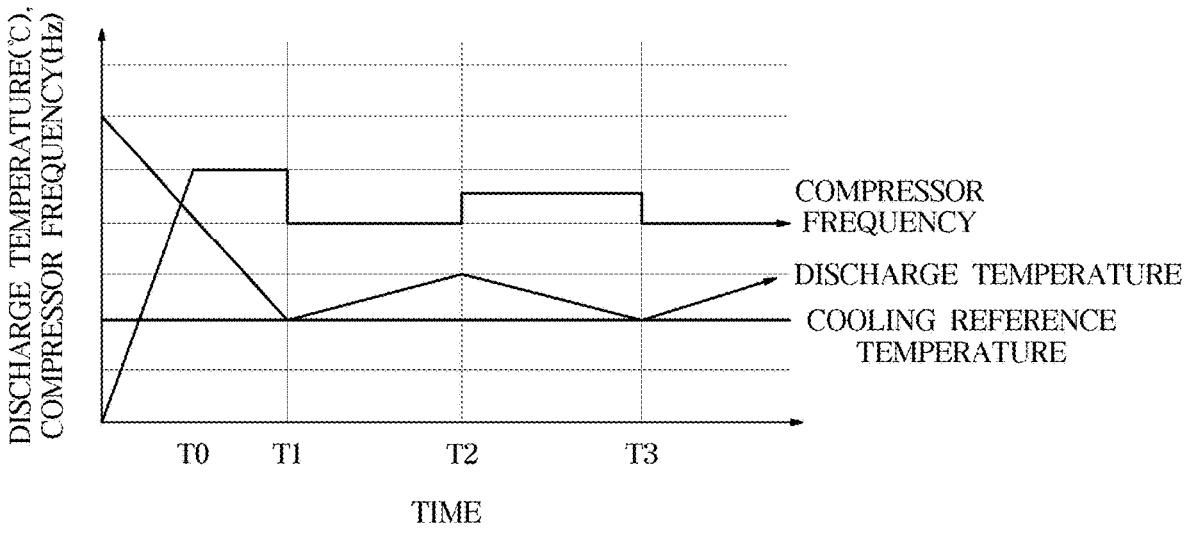
Figure 9:
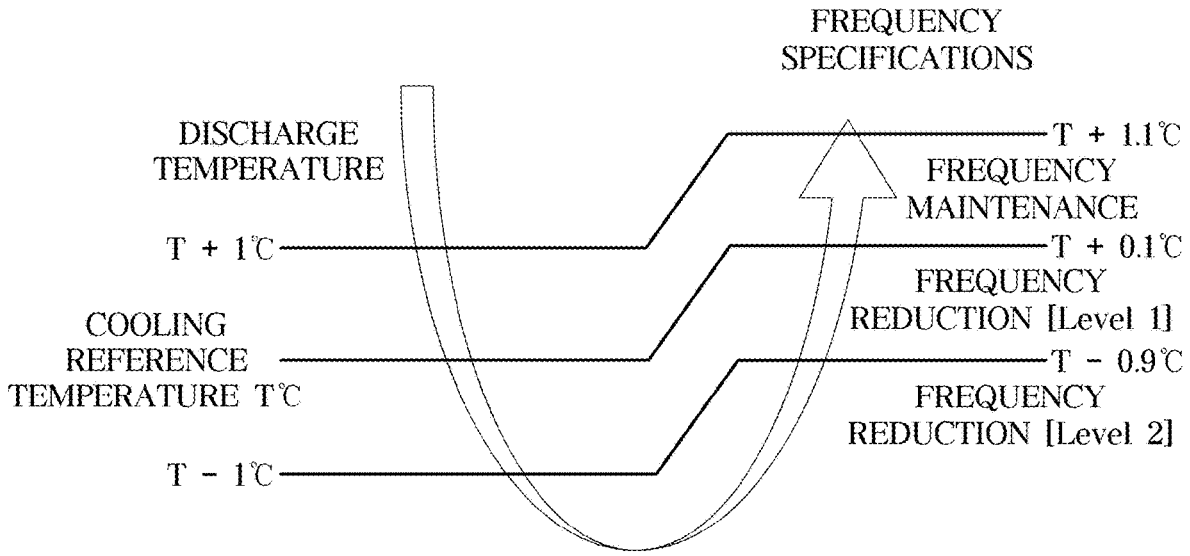

FIGS. 8, 9, and 10 illustrate a relationship between an operating frequency of a compressor and a discharge temperature during the cooling operation of the air conditioner according to various embodiments of the disclosure.

Referring to FIG. 7, in response to the controller 150 receiving an input for the cooling operation mode and receiving a target temperature in the cooling operation mode through the inputter 110 at operation 701, the controller 150 operates the compressor 170 to allow a temperature of the indoor air to reach the target temperature at operation 702. The controller 150 may increase the operating frequency of the compressor 170 at regular intervals, so as to allow the intake temperature to reach the target temperature, or may perform the fuzzy control to allow the intake temperature to follow the target temperature according to the fuzzy table.

Referring to FIG. 8, in response to the start of the cooling operation, the operating frequency of the compressor 170 increases to T0. At this time, T0 may correspond to a point of time in which the intake temperature reaches the target temperature and a point of time in which the operating frequency of the compressor is no longer increased.

The controller 150 continuously obtains the intake temperature and the discharge temperature measured through the intake temperature sensor 130 and the discharge temperature sensor 140 at operation 703.

In principle, the controller 150 stops the operation of the compressor 170 at operation 705 in response to the intake temperature, which is the temperature of the indoor air, reaching the target temperature set by the user at operation 704. In this case, the operation of the compressor 170 is temporarily stopped. The intake temperature reaches the target temperature and the target temperature is maintained for a certain period of time. However, in a state in which the operation of the compressor 170 is stopped, a difference occurs between the discharge temperature and the target temperature that is desired by the user. Therefore, it is difficult to provide a consistent perceived temperature desired by the user.

Accordingly, according to the disclosure, the controller 150 may control the compressor 170 based on comparison between the reference temperature and the discharge temperature rather than the intake temperature.

In response to the intake temperature not reaching the target temperature, the controller 150 performs compressor capacity control (fuzzy control) at operation 706. By performing the fuzzy control, the controller 150 may adjust the operating frequency to allow the intake temperature to follow the target temperature.

The controller 150 may increase or decrease the operating frequency to allow the intake temperature to follow the target temperature according to the fuzzy control. The controller 150 performs a comparison between the discharge temperature and the cooling reference temperature during the capacity control. In response to the discharge temperature reaching a cooling reference temperature at operation 707, the controller 150 controls the operating frequency of the compressor to decrease at operation 708. In response to the controller 150 detecting that the discharge temperature reaches the reference temperature, the controller 150 may decrease the operating frequency of the compressor 170 instead of stopping the operation of the compressor 170. At this time, the operation of the compressor 170 may be not stopped and the compressor 170 may be operated while maintaining the reduced operating frequency. Accordingly, it is possible to prevent the discharge temperature from increasing rapidly. Therefore, even when the air conditioner 1 is temporarily stopped due to reaching the target temperature, appropriate cold air may be provided to the user to provide a consistent perceived temperature.

More particularly, the controller 150 maintains the operating frequency for a certain period of time from the point of time in which the intake temperature reaches the target temperature TO. In response to the discharge temperature reaching the cooling reference temperature while the operating frequency is maintained T1 (refer to FIG. 8), the controller 150 may reduce the operating frequency. When an operating frequency that is immediately before the discharge temperature reaches the reference temperature is a first operating frequency, an operating frequency that is immediately after the discharge temperature reaches the reference temperature may be a second operating frequency. In response to the discharge temperature reaching the reference temperature, the controller 150 may maintain the operating frequency at the second operating frequency reduced from the first operating frequency.

Meanwhile, the second operating frequency is a frequency of the compressor 170 that is not sufficient to lower the discharge temperature and the intake temperature, and may only prevent the discharge temperature from rising rapidly when the compressor 170 is operated at the second operating frequency. Accordingly, the discharge temperature increases while the compressor 170 is operated at the second operating frequency.

The controller 150 controls the operating frequency of the compressor 170 to increase in order to prevent the discharge temperature from continuously increasing. When the discharge temperature increases in a section in which the compressor is operated at the second operating frequency, and reaches a predetermined first temperature T2 (refer to FIG. 8), the controller 150 may increase the second operating frequency to a third operating frequency, and maintain the operating frequency of the compressor 170 at the third operating frequency. The predetermined first temperature is a temperature that is a certain level higher than the cooling reference temperature and is based on a reference by which the user cannot detect a change in the discharge temperature. The discharge temperature falls again toward the reference temperature.

Through the above-described process, it is possible to prevent the user from feeling a change in the discharge temperature. According to one embodiment of the disclosure, the controller 150 may reduce the discharge temperature in the section in which the compressor 170 is operated at the third operating frequency, and the controller 150 may maintain the second operating frequency, which is reduced from the third operating frequency, in response to the discharge temperature reaching the reference temperature T3 (refer to FIG. 8) from the predetermined first temperature.

Referring to FIG. 9, during the cooling operation, the controller 150 controls the compressor 170 to allow the operating frequency to be reduced by a first level in response to the discharge temperature being less than the cooling reference temperature by 1° C. or less, and the controller 150 controls the compressor 170 to allow the operating frequency to be reduced by a second level, which is greater than the first level, in response to the discharge temperature being less than the cooling reference temperature by a value greater than 1° C. Further, the controller 150 controls the compressor 170 to maintain the operating frequency so as to allow the discharge temperature to reach the reference temperature in response to the discharge temperature being greater than the cooling reference temperature by 1° C. or less. FIG. 10 illustrates a quantitative relationship between the discharge temperature and an amount of reduction in the operating frequency according to an embodiment of the disclosure. However, the values shown in FIG. 10 are only an example, and each configuration of the air conditioner 1 may have different values according to the performance and manufacturing stage settings.

Figure 11:
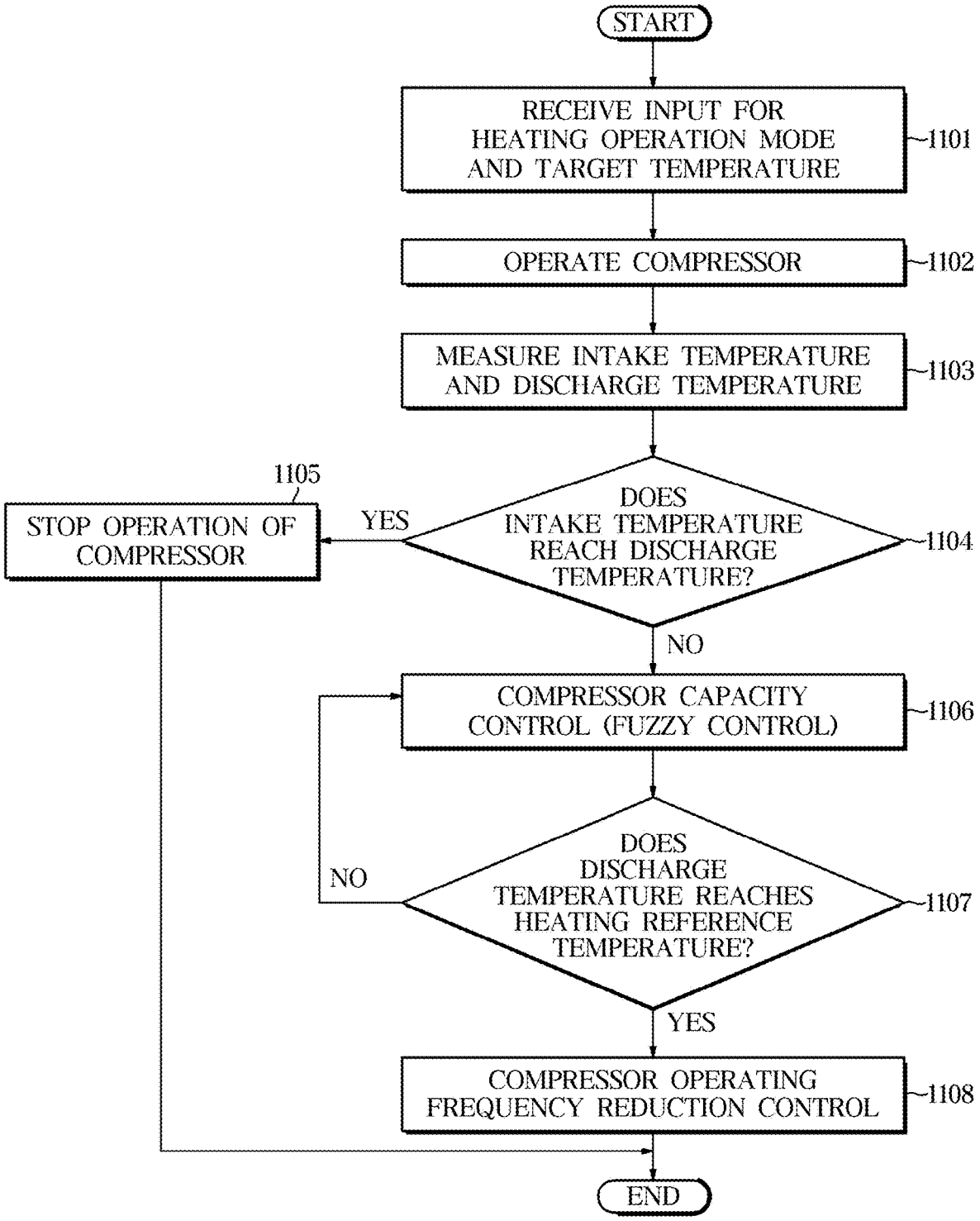
FIG. 11 is a flowchart of a control method of an air conditioner according to an embodiment of the disclosure.
Figure 12:
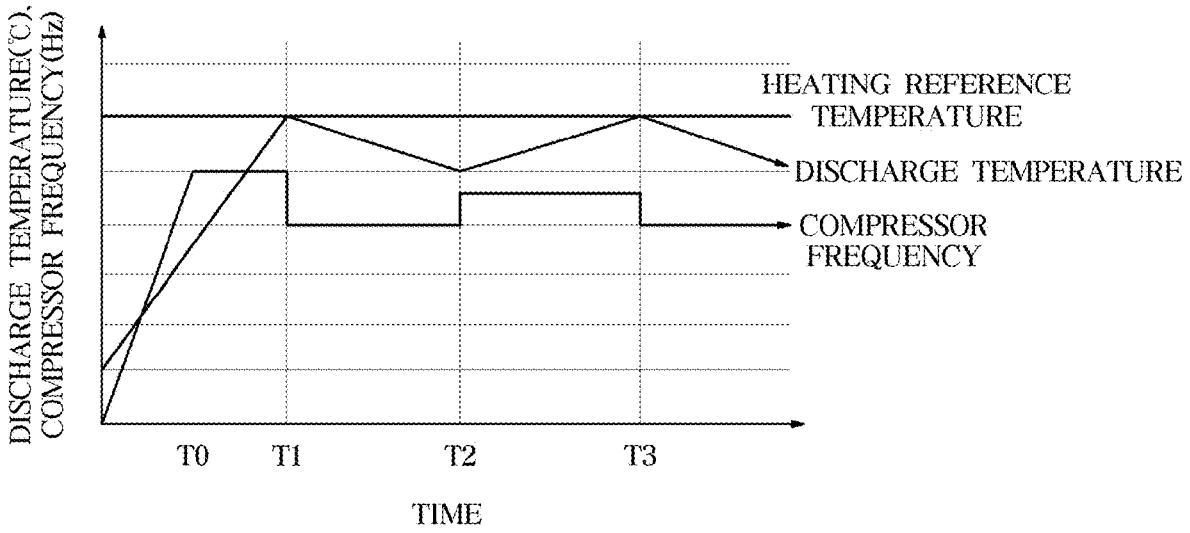
Figure 13:
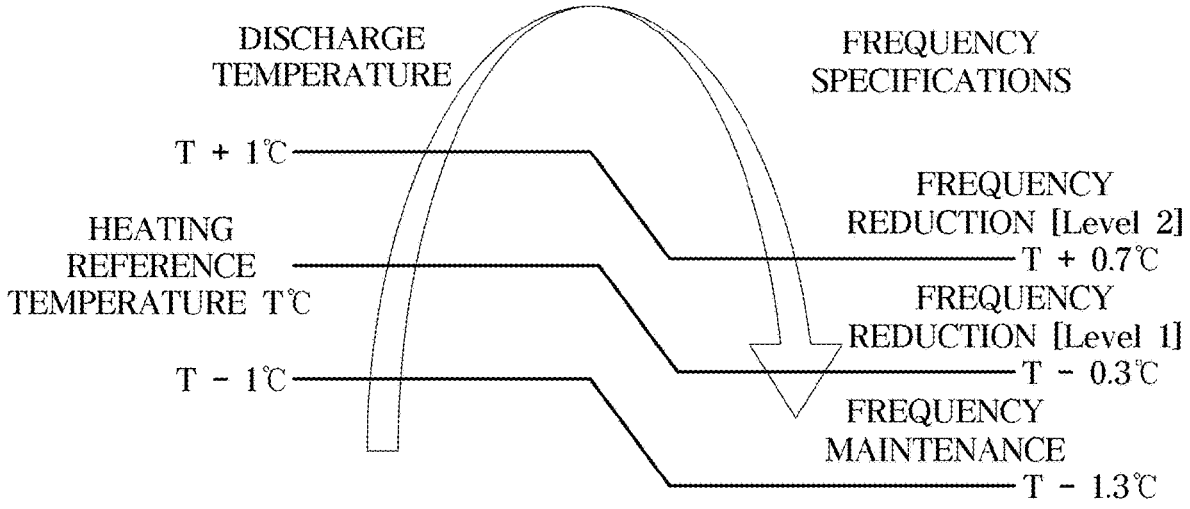

FIG. 11 is a flowchart of a control method of an air conditioner according to an embodiment of the disclosure. FIGS. 12, 13, and 14 illustrate a relationship between an operating frequency of a compressor and a discharge temperature during a heating operation of an air conditioner according to various embodiments of the disclosure.

Referring to FIG. 11, in response to the controller 150 receiving an input for the heating operation mode and receiving a target temperature in the heating operation mode through the inputter 110 at operation 1101, the controller 150 operates the compressor 170 to allow a temperature of the indoor air to reach the target temperature at operation 1102. The controller 150 may increase the operating frequency of the compressor 170 at regular intervals, so as to allow the intake temperature to reach the target temperature, or may perform the fuzzy control to allow the intake temperature to follow the target temperature according to the fuzzy table. Referring to FIG. 12, in response to the start of the heating operation, the operating frequency of the compressor 170 increases to T0. At this time, T0 may correspond to a point of time in which the intake temperature reaches the target temperature and a point of time in which the operating frequency of the compressor is no longer increased.

The controller 150 continuously obtains the intake temperature and the discharge temperature measured through the intake temperature sensor 130 and the discharge temperature sensor 140 at operation 1103.

In principle, the controller 150 stops the operation of the compressor 170 at operation 1105 in response to the intake temperature, which is the temperature of the indoor air, reaching the target temperature set by the user at operation 1104. In this case, the operation of the compressor 170 is temporarily stopped. The intake temperature reaches the target temperature and the target temperature is maintained for a certain period of time. However, in a state in which the operation of the compressor 170 is stopped, a difference occurs between the discharge temperature and the target temperature that is desired by the user. Therefore, it is difficult to provide a consistent perceived temperature desired by the user.

Accordingly, in the heating operation mode in the same manner as the cooling operation mode, the controller 150 may control the compressor 170 based on comparison between the reference temperature and the discharge temperature rather than the intake temperature.

In response to the intake temperature not reaching the target temperature, the controller 150 performs compressor capacity control (fuzzy control) at operation 1106. By performing the fuzzy control, the controller 150 may adjust the operating frequency to allow the intake temperature to follow the target temperature.

The controller 150 may increase or decrease the operating frequency to allow the intake temperature to follow the target temperature according to the fuzzy control. The controller 150 performs a comparison between the discharge temperature and the heating reference temperature during the capacity control. In response to the discharge temperature reaching the heating reference temperature at operation 1107, the controller 150 controls the operating frequency of the compressor to decrease at operation 1108. In response to the controller 150 detecting that the discharge temperature reaches the reference temperature, the controller 150 may decrease the operating frequency of the compressor 170 instead of stopping the operation of the compressor 170. At this time, the operation of the compressor 170 may be not stopped and the compressor 170 may be operated while maintaining the reduced operating frequency. Accordingly, it is possible to prevent the discharge temperature from decreasing rapidly. Therefore, even when the air conditioner 1 is temporarily stopped due to reaching the target temperature, appropriate warm air may be provided to the user to provide the consistent perceived temperature.

More particularly, the controller 150 maintains the operating frequency for a certain period of time in response to the intake temperature reaching the target temperature TO. In response to the discharge temperature reaching the heating reference temperature while the operating frequency is maintained T1 (refer to FIG. 12), the controller 150 may reduce the operating frequency. When an operating frequency that is immediately before the discharge temperature reaches the reference temperature is a first operating frequency, an operating frequency that is immediately after the discharge temperature reaches the reference temperature may be a second operating frequency. In response to the discharge temperature reaching the reference temperature, the controller 150 may maintain the operating frequency at the second operating frequency reduced from the first operating frequency.

Meanwhile, the second operating frequency is a frequency of the compressor 170 that is not sufficient to increase the discharge temperature and the intake temperature, and may only prevent the discharge temperature from decreasing rapidly when the compressor 170 is operated at the second operating frequency. Accordingly, the discharge temperature decreases while the compressor 170 is operated at the second operating frequency.

The controller 150 controls the operating frequency of the compressor 170 to increase in order to prevent the discharge temperature from continuously decreasing. When the discharge temperature decreases in a section in which the compressor is operated at the second operating frequency, and reaches a predetermined second temperature T2 (refer to FIG. 12), the controller 150 may increase the second operating frequency to a fourth operating frequency, and maintain the operating frequency of the compressor 170 at the fourth operating frequency. The predetermined second temperature is a temperature that is a certain level lower than the heating reference temperature and is based on a reference by which the user cannot detect a change in the discharge temperature. The discharge temperature increases again toward the reference temperature.

Through the above-described process, it is possible to prevent the user from feeling a change in the discharge temperature. According to one embodiment of the disclosure, the controller 150 may increase the discharge temperature in the section in which the compressor 170 is operated at the fourth operating frequency, and the controller 150 may maintain the second operating frequency, which is reduced from the fourth operating frequency, in response to the discharge temperature reaching the reference temperature T3 from the predetermined second temperature (refer to FIG. 12).

Referring to FIG. 13, during the heating operation, the controller 150 controls the compressor 170 to allow the operating frequency to be reduced by a first level in response to the discharge temperature being less than the heating reference temperature by 1° C. or less, and the controller 150 controls the compressor 170 to maintain the operating frequency in response to the discharge temperature being less than the heating reference temperature by a value greater than 1° C. This is to increase the operating frequency so as to allow the discharge temperature to reach the target temperature. Further, the controller 150 controls the compressor 170 to allow the operating frequency to be reduced by a second level, which is greater than the first level, in response to the discharge temperature being greater than the cooling reference temperature by 1° C. or less. FIG. 14 illustrates a quantitative relationship between the discharge temperature and an amount of reduction in the operating frequency according to an embodiment of the disclosure. However, the values shown in FIG. 14 are only an example, and each configuration of the air conditioner 1 may have different values according to the performance and manufacturing stage settings.

In response to the start of one of the cooling operation and the heating operation, the controller 150 according to one embodiment adjusts the operating frequency of the compressor 170 to allow the intake temperature to reach the target temperature. At this time, in response to the intake temperature reaching the target temperature or in response to the discharge temperature reaching the cooling reference temperature or the heating reference temperature after a certain period of time elapses after the intake temperature reaches the target temperature, the controller 150 may control the compressor 170 to reduce the operating frequency. The controller 150 may change the operating frequency of the compressor 170 (e.g., fuzzy control) or stop the compressor 170 based on the intake temperature. For example, the controller 150 may stop the compressor 170 when the intake temperature reaches the target temperature set by the user or when a certain period of time elapses after the intake temperature reaches the target temperature. However, in the embodiment of the disclosure, the stopping of the compressor 170 may be postponed according to the discharge temperature and the reference temperature. In response to the intake temperature reaching the target temperature or in response to the discharge temperature reaching the reference temperature after the intake temperature reaches the target temperature, the controller 150 may control the compressor 170 to reduce the operating frequency instead of stopping the compressor 170.

Figure 15:
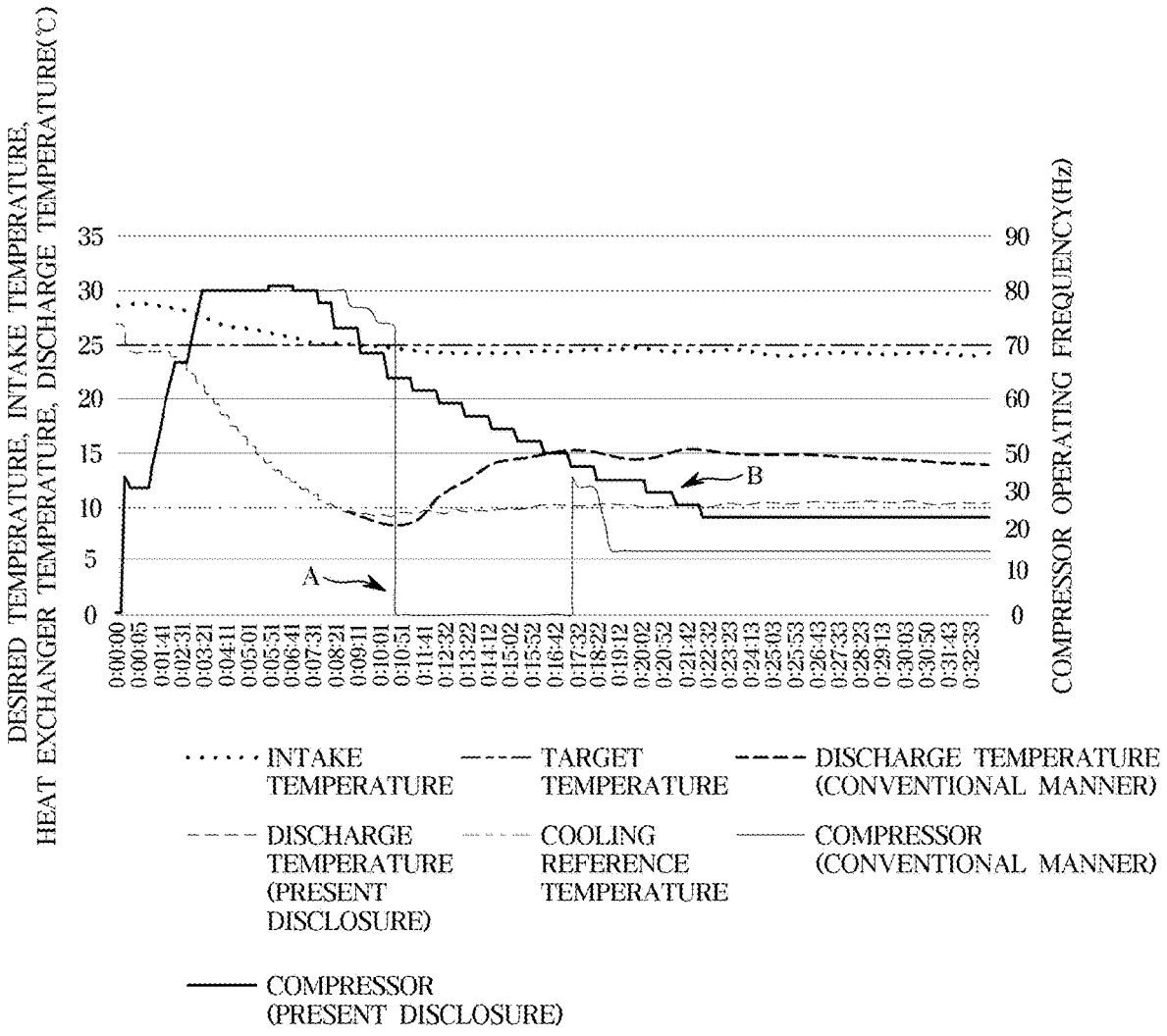
FIG. 15 illustrates a difference in compressor control between an air conditioner and an air conditioner of the related art according to an embodiment of the disclosure.

Meanwhile, FIG. 15 illustrates a difference in compressor control between the air conditioner according to one embodiment and an air conditioner of the related art.

FIG. 15 illustrates a difference between compressor control of the related art and compressor control when an air conditioner 1 performs a cooling operation according to an embodiment of the disclosure.

Referring to FIG. 15, the change in the operating frequency of the compressor is the same after a certain period of time (approximately 0:07:31) from the start of the cooling operation (0:00:00). However, in the case of compressor control of the related art, when the intake temperature reaches the target temperature, the operation of the compressor is temporarily stopped (A) (0:10:51~0:17:32), and the discharge temperature increases while the operation of the compressor is stopped. At this time, the user can feel a perceived temperature that is different from the target temperature.

In contrast, in the disclosure, even when the intake temperature reaches the target temperature, the operating frequency of the compressor is changed (B) (0:10:51 to 0:22:32) through comparison between the discharge temperature and the cooling reference temperature. Accordingly, it is possible to prevent the discharge temperature from rising rapidly. Unlike the compressor control of the related art, the discharge temperature of the air conditioner is maintained close to the target temperature, and thus the user can feel the same perceived temperature as the target temperature. The principle of controlling the operating frequency of the compressor described above may be equally applied to the heating operation.

Meanwhile, the disclosed embodiments may be embodied in the form of a recording medium storing instructions executable by a computer. The instructions may be stored in the form of program code and, when executed by a processor, may generate a program module to perform the operations of the disclosed embodiments. The recording medium may be embodied as a computer-readable recording medium.

The computer-readable recording medium includes all kinds of recording media in which instructions which can be decoded by a computer are stored. For example, there may be read only memory (ROM), random access memory (RAM), a magnetic tape, magnetic disk, flash memory, and an optical data storage device.

Storage medium readable by machine, may be provided in the form of a non-transitory storage medium. "Non-transitory" means that the storage medium is a tangible device and does not contain a signal (e.g., electromagnetic wave), and this term includes a case in which data is semi-permanently stored in a storage medium and a case in which data is temporarily stored in a storage medium.

The method according to the various disclosed embodiments may be provided by being included in a computer program product. Computer program products may be traded between sellers and buyers as commodities. Computer program products are distributed in the form of a device-readable storage medium (e.g., compact disc read only memory (CD-ROM)), or are distributed directly or online (e.g., downloaded or uploaded) between two user devices (e.g., smartphones) through an application store (e.g., Play Store™). In the case of online distribution, at least a portion of the computer program product (e.g., downloadable app) may be temporarily stored or created temporarily in a device-readable storage medium, such as the manufacturer's server, the application store's server, or the relay server's memory.

It will be appreciated that various embodiments of the disclosure according to the claims and description in the specification can be realized in the form of hardware, software or a combination of hardware and software.

Any such software may be stored in non-transitory computer readable storage media. The non-transitory computer readable storage media store one or more computer programs (software modules), the one or more computer programs include computer-executable instructions that, when executed by one or more processors of an electronic device, cause the electronic device to perform a method of the disclosure.

Any such software may be stored in the form of volatile or non-volatile storage, such as, for example, a storage device like read only memory (ROM), whether erasable or rewritable or not, or in the form of memory, such as, for example, random access memory (RAM), memory chips, device or integrated circuits or on an optically or magnetically readable medium, such as, for example, a compact disk (CD), digital versatile disc (DVD), magnetic disk or magnetic tape or the like. It will be appreciated that the storage devices and storage media are various embodiments of non-transitory machine-readable storage that are suitable for storing a computer program or computer programs comprising instructions that, when executed, implement various embodiments of the disclosure. Accordingly, various embodiments provide a program comprising code for implementing apparatus or a method as claimed in any one of the claims of this specification and a non-transitory machine-readable storage storing such a program.

While the disclosure has been shown and described with reference to various embodiments thereof, it will be understood by those of skilled in the art that various changes in form and details may be made therein without departing from the spirit and scope of the disclosure as defined by the appended claims and their equivalents.

What is claimed is:

1. An air conditioner comprising:

a compressor configured to compress a refrigerant;

an indoor heat exchanger in which heat exchange between indoor air and the refrigerant is performed;

a discharge temperature sensor configured to measure a discharge temperature of air at which the heat exchange is completed;

an intake temperature sensor configured to measure an intake temperature of the indoor air drawn into the indoor heat exchanger;

an inputter configured to receive a target temperature from a user;

memory storing one or more computer programs; and one or more processors communicatively coupled the compressor, the indoor heat exchanger, the discharge temperature sensor, the intake temperature sensor, the inputter, and the memory, wherein the one or more computer programs include computer-executable instructions that, when executed by the one or more processors individually or collectively, cause the air conditioner to:

adjust an operating frequency of the compressor by comparing the intake temperature and the target temperature, and control the compressor to reduce the operating frequency in response to the discharge temperature reaching a reference temperature, wherein, in response to the discharge temperature reaching the reference temperature after the intake temperature reaches the target temperature, the one or more computer programs further include computer-executable instructions that, when executed by the one or more processors individually or collectively, cause the air conditioner to control the compressor to reduce the operating frequency instead of stopping the compressor.

2. The air conditioner of claim 1, wherein the one or more computer programs further include computer-executable instructions that, when executed by the one or more processors individually or collectively, cause the air conditioner to adjust the operating frequency of the compressor or stop the compressor based on the intake temperature.

3. The air conditioner of claim 1, wherein the one or more computer programs further include computer-executable instructions that, when executed by the one or more processors individually or collectively, cause the air conditioner to maintain the operating frequency at a second operating frequency reduced from a first operating frequency in response to the discharge temperature reaching the reference temperature.

4. The air conditioner of claim 3, wherein, in response to the discharge temperature increasing in a section, in which the compressor is operated at the second operating frequency, and reaching a predetermined first temperature, the one or more computer programs further include computer-executable instructions that, when executed by the one or more processors individually or collectively, cause the air conditioner to maintain a third operating frequency increased from the second operating frequency.

5. The air conditioner of claim 4, wherein, in response to the discharge temperature decreasing in a section, in which the compressor is operated at the third operating frequency, and reaching the reference temperature, the one or more computer programs further include computer-executable instructions that, when executed by the one or more processors individually or collectively, cause the air conditioner to maintain the second operating frequency reduced from the third operating frequency.

6. The air conditioner of claim 5, wherein the reference temperature is a predetermined cooling reference temperature.

7. The air conditioner of claim 3, wherein, in response to the discharge temperature decreasing in a section, in which the compressor is operated at the second operating frequency, and reaching a predetermined second temperature, the one or more computer programs further include computer-executable instructions that, when executed by the one or more processors individually or collectively, cause the air conditioner to maintain a fourth operating frequency increased from the second operating frequency.

8. The air conditioner of claim 7, wherein, in response to the discharge temperature increasing in a section, in which the compressor is operated at the fourth operating frequency, and reaching the reference temperature, the one or more computer programs further include computer-executable instructions that, when executed by the one or more processors individually or collectively, cause the air conditioner to maintain the second operating frequency reduced from the fourth operating frequency.

9. The air conditioner of claim 8, wherein the reference temperature is a predetermined heating reference temperature.

10. The air conditioner of claim 3, wherein the one or more computer programs further include computer-executable instructions that, when executed by the one or more processors individually or collectively, cause the air conditioner to:

control the compressor to increase the operating frequency to the first operating frequency in response to start of a cooling operation or heating operation; and maintain the first operating frequency in response to the intake temperature reaching the target temperature.

11. The air conditioner of claim 3, wherein the one or more computer programs further include computer-executable instructions that, when executed by the one or more processors individually or collectively, cause the air conditioner to control the operating frequency based on a predetermined fuzzy table in a section in which the operating frequency is increased to the first operating frequency.

12. A method of controlling an air conditioner comprising:

a compressor configured to compress a refrigerant;

an indoor heat exchanger in which heat exchange between indoor air and the refrigerant is performed;

a discharge temperature sensor configured to measure a discharge temperature;

an intake temperature sensor configured to measure an intake temperature; and an inputter configured to receive a target temperature from a user, the method comprising:

receiving the target temperature from the user, obtaining the intake temperature and the discharge temperature, adjusting an operating frequency of the compressor by comparing the intake temperature and the target temperature, controlling the compressor to reduce the operating frequency of the compressor in response to the discharge temperature reaching a reference temperature, and controlling the compressor to reduce the operating frequency instead of stopping the compressor, in response to the discharge temperature reaching the reference temperature after the intake temperature reaches the target temperature.

13. The method of claim 12, wherein the controlling of the compressor comprises:

adjusting the operating frequency of the compressor or stopping the compressor based on the intake temperature.

14. The method of claim 13, wherein the controlling of the compressor comprises:

maintaining the operating frequency at a second operating frequency reduced from a first operating frequency in response to the discharge temperature reaching the reference temperature.

15. The method of claim 14, wherein, in response to the discharge temperature increasing in a section, in which the compressor is operated at the second operating frequency, and reaching a predetermined first temperature, maintaining a third operating frequency increased from the second operating frequency.

16. The method of claim 15, wherein, in response to the discharge temperature decreasing in a section, in which the compressor is operated at the third operating frequency, and reaching the reference temperature, maintaining the second operating frequency reduced from the third operating frequency.

17. The method of claim 15, wherein the reference temperature is a predetermined cooling reference temperature.

18. The method of claim 13, wherein the reference temperature is determined based on at least one of a size of the indoor heat exchanger and a blowing capacity of the air conditioner.

19. One or more non-transitory computer-readable storage media storing computer-executable instructions that, when executed by one or more processors individually or collectively, cause an air conditioner to perform operations of controlling the air conditioner comprising:

a compressor configured to compress a refrigerant;

an indoor heat exchanger in which heat exchange between indoor air and the refrigerant is performed;

a discharge temperature sensor configured to measure a discharge temperature;

an intake temperature sensor configured to measure an intake temperature; and an inputter configured to receive a target temperature from a user, the operations comprising:

receiving the target temperature from the user, obtaining the intake temperature and the discharge temperature, adjusting an operating frequency of the compressor by comparing the intake temperature and the target temperature, controlling the compressor to reduce the operating frequency of the compressor in response to the discharge temperature reaching a reference temperature, and controlling the compressor to reduce the operating frequency instead of stopping the compressor, in response to the discharge temperature reaching the reference temperature after the intake temperature reaches the target temperature.

20. The one or more non-transitory computer-readable storage media of claim 19, the operations further comprising:

adjusting the operating frequency of the compressor or stopping the compressor based on the intake temperature.

* * * * *